US012692612B2

(12) United States Patent
Lubomirsky et al.

(10) Patent No.: US 12,692,612 B2
(45) Date of Patent: Jul. 28, 2026

(54) RECOVERY OF RARE EARTH METALS FROM FERROMAGNETIC ALLOYS

(71) Applicant: YEDA RESEARCH AND DEVELOPMENT CO. LTD., Rehovot (IL)

(72) Inventors: Igor Lubomirsky, Petach-Tikva (IL); Valery Kaplan, Rehovot (IL)

(73) Assignee: YEDA RESEARCH AND DEVELOPMENT CO. LTD., Rehovot (IL)

( * ) Notice: Subject to any disclaimer, the term of this patent is extended or adjusted under 35 U.S.C. 154(b) by 1244 days.

(21) Appl. No.: 17/462,047

(22) Filed: Aug. 31, 2021

(65) Prior Publication Data

US 2022/0002890 A1 Jan. 6, 2022

Related U.S. Application Data

(63) Continuation-in-part of application No. PCT/IL2021/050811, filed on Jul. 1, 2021.

(60) Provisional application No. 63/046,727, filed on Jul. 1, 2020.

(51) Int. Cl.

| | |
|---|---|
| ***C25C 1/06*** | (2006.01) |
| ***C25C 1/22*** | (2006.01) |
| ***C25C 5/00*** | (2006.01) |

(52) U.S. Cl.

CPC ..... *C25C 1/22* (2013.01); *C25C 1/06* (2013.01); *C25C 5/00* (2013.01)

(58) Field of Classification Search

CPC .... C25C 1/22; C25C 1/06; C25C 5/00; C25C 3/34; C25C 3/00; C25C 7/005; C25C 7/00; C22B 3/045; C22B 59/00; C22B 7/006; C22B 7/007; C22B 3/44; C22B 3/22; B22F 9/00; B22F 9/023; B22F 2301/355; B22F 8/00; B22F 1/05; B22F 2998/10; B22F 2999/00; B22F 2009/001; B22F 9/04; B22F 2009/043; Y02P 10/20; H01F 41/0253; C01F 17/10; C25D 3/665; C25D 11/34

See application file for complete search history.

(56) References Cited

U.S. PATENT DOCUMENTS

| | | | |
|---|---|---|---|
| 2,828,200 | A | 3/1958 | Nixon |
| 2,860,045 | A | 11/1958 | Nixon et al. |
| 3,021,209 | A | 2/1962 | Murray et al. |
| 3,951,648 | A | 4/1976 | Stern et al. |

(Continued)

FOREIGN PATENT DOCUMENTS

| | | |
|---|---|---|
| CN | 101663242 | 3/2010 |
| CN | 101817547 | 9/2010 |

(Continued)

OTHER PUBLICATIONS

Meng et al ("Clean production of rare earth oxide from rare earth chloride solution by electrical transformation", Hydrometallurgy 197 (2020)105372) (Year: 2020).*

(Continued)

*Primary Examiner* — Xiuyu Tai

(74) *Attorney, Agent, or Firm* — Mark S. Cohen; PEARL COHEN LLP

(57) ABSTRACT

Methods for recovery of at least one rare earth metal from ferromagnetic alloy are described, and further methods of atomic hydrogen decrepitation of a ferromagnetic alloy.

19 Claims, 15 Drawing Sheets

1 – Electrolytic bath, 2 – Titanium Cathode, 3 – Magnet pieces, 4 – Titanium Grid, 5 – Nickel Anode, 6 – KOH solution, 7 – Fragmented magnet powder.

(56) References Cited

U.S. PATENT DOCUMENTS

| | | | |
|---|---|---|---|
| 3,986,982 | A | 10/1976 | Crowson et al. |
| 4,074,865 | A | 2/1978 | Gibbon |
| 4,353,740 | A | 10/1982 | Dunn |
| 4,608,083 | A | 8/1986 | Holmstrom et al. |
| 4,960,573 | A | 10/1990 | Okutani et al. |
| 5,074,910 | A | 12/1991 | Dubrovsky |
| 5,102,632 | A | 4/1992 | Allen et al. |
| 5,104,445 | A | 4/1992 | Dubrovsky et al. |
| 5,169,503 | A | 12/1992 | Baughman et al. |
| 5,190,625 | A | 3/1993 | Seon et al. |
| 5,484,470 | A | 1/1996 | Kristjansdottir et al. |
| 6,455,018 | B1 | 9/2002 | Cuif |
| 7,291,202 | B2 | 11/2007 | Asano et al. |
| 7,601,318 | B2 | 10/2009 | Armand et al. |
| 7,645,320 | B2 | 1/2010 | Evans |
| 7,972,412 | B2 | 7/2011 | Bergeron et al. |
| 8,734,714 | B2 | 5/2014 | Harris et al. |
| 8,852,547 | B2 | 10/2014 | Ma et al. |
| 8,974,572 | B2 | 3/2015 | Uehara et al. |
| 9,194,022 | B2 | 11/2015 | Roy et al. |
| 10,167,532 | B2 | 1/2019 | Laucournet et al. |
| 10,457,999 | B2 | 10/2019 | Lubomirsky et al. |
| 11,718,893 | B2 | 8/2023 | Lubomirsky et al. |
| 2007/0131058 | A1 | 6/2007 | Bergeron et al. |
| 2009/0226352 | A1 | 9/2009 | Hsu et al. |
| 2010/0257978 | A1 | 10/2010 | Bergeron et al. |
| 2013/0089477 | A1 | 4/2013 | Uehara |
| 2015/0104361 | A1 | 4/2015 | Boudreault et al. |
| 2015/0203979 | A1 | 7/2015 | Seetharaman et al. |
| 2017/0145542 | A1 | 5/2017 | Lubomirsky et al. |
| 2018/0171434 | A1 | 6/2018 | Berggren et al. |
| 2020/0332391 | A1 | 10/2020 | Lubomirsky et al. |
| 2021/0017654 | A1* | 1/2021 | Grader ..... C25B 9/70 |
| 2021/0280344 | A1 | 9/2021 | Chen et al. |

FOREIGN PATENT DOCUMENTS

| | | | |
|---|---|---|---|
| CN | 102923796 | | 2/2013 |
| CN | 103258730 | | 8/2013 |
| CN | 105400962 | | 3/2016 |
| CN | 106910889 | | 6/2017 |
| CN | 107742760 | | 2/2018 |
| CN | 109652655 | | 4/2019 |
| CN | 110093505 | A | 8/2019 |
| CN | 110938743 | | 3/2020 |
| DE | 4429895 | A1 | 2/1995 |
| DE | 102013205408 | | 10/2014 |
| EP | 0538320 | B1 | 6/1994 |
| EP | 3267506 | B1 | 1/2018 |
| EP | 3795704 | A1 | 3/2021 |
| GB | 798712 | | 7/1958 |
| JP | S50-32018 | A | 3/1975 |
| JP | S51-123723 | A | 10/1976 |
| JP | H-02301528 | | 12/1990 |
| JP | H-03-13532 | A | 1/1991 |
| JP | H04329804 | A | 11/1992 |
| JP | 2000-144275 | | 5/2000 |
| JP | 2001-026426 | | 1/2001 |
| JP | 2001335852 | | 12/2001 |
| JP | 2003-073754 | | 3/2003 |
| JP | 2001-152265 | | 8/2005 |
| JP | 2012-229481 | A | 11/2012 |
| JP | 1912219326 | A | 11/2012 |
| JP | 2012219326 | | 11/2012 |
| JP | 2016-056393 | | 4/2016 |
| JP | 2018197385 | A | 12/2018 |
| JP | 6651115 | B1 | 2/2020 |
| KR | 100959928 | B1 | 5/2010 |
| WO | WO 1992/00595 | | 1/1992 |
| WO | WO 1999/022036 | A1 | 5/1999 |
| WO | WO 2008-131856 | | 11/2008 |
| WO | WO 2011/082595 | | 7/2011 |
| WO | WO 2012-101398 | | 8/2012 |
| WO | WO 2014-091456 | | 6/2014 |
| WO | WO 2015-193901 | | 12/2015 |
| WO | WO2017006209 | A1 | 1/2017 |
| WO | WO 2018-078632 | | 5/2018 |
| WO | WO 2019/053148 | | 3/2019 |
| WO | WO 2019-087193 | | 5/2019 |
| WO | WO 2022/003694 | A1 | 1/2022 |

OTHER PUBLICATIONS

Chase MW, "National Information Standards Organization (US). NIST-JANAf thermochemical tables" Washington, DC: American Chemical Society; Aug. 1, 1998.

Cojocaru et al. "Modification of the Bloch law in ferromagnetic nanostructures" EPL (Europhysics Letters). Mar. 31, 2014;106(1):17001.

"Electromagnetic Spectrum" Cosmos: , 2007, Swineburne University of Technology.

Gutfleisch et al. "Recycling Used Nd—Fe—B Sintered Magnets via a Hydrogen-Based Route to Produce Anisotropic, Resin Bonded Magnets" Advanced Energy Materials. Feb. 2013;3(2):151-5.

International Search Report for PCT Application No. PCT/IL2021/050811 dated Oct. 6, 2021.

Li et al. "Recycling of scrap sintered Nd—Fe—B magnets as anisotropic bonded magnets via hydrogen decrepitation process" Journal of Material Cycles and Waste Management. Jul. 2015;17(3):547-52.

Renzel A. "Overview UV-lamps" 2012, UV-Technik Meyer GMBH.

Sheridan et al. "Improved HDDR processing route for production of anisotropic powder from sintered NdFeB type magnets" Journal of Magnetism and Magnetic Materials. Jan. 1, 2014;350:114-8.

Szymański et al. "Recycling of Nd—Fe—B magnets from scrap hard disc drives" Key Engineering Materials. Mar. 31, 2016;682:308-13.

Ye et al. "Magnetoelectric Tuning of Pinning-Type Permanent Magnets through Atomic-Scale Engineering of Grain Boundaries" Advanced Materials. Feb. 2021;33(5):2006853.

Asabe, K. et al. (2001). Recycling of rare earth magnet scraps: Part I carbon removal by high temperature oxidation. Materials transactions, 42(12), 2487-2491.

Assefi, M. et al. (2020). Pyrometallurgical recycling of Li-ion, Ni—Cd and Ni-MH batterics: A minireview. Current Opinion in Green and Sustainable Chemistry, 24, 26-31.

B2H6 (Diborane) Safety Data Sheet P-4586 (Praxair).

Bae, K. H. et al. (2012). Effects of DyHx and Dy2O3 powder addition on magnetic and microstructural properties of Nd—Fc—B sintered magnets. Journal of Applied Physics, 112(9), 093912.

Binnemans, K. et al. (2013). Recycling of rare earths: a critical review. Journal of cleaner production, 51, 1-22.

Cadogan, J.M. et al. (1986). Hydrogen absorption and desorption in Nd2Fe14B. Appl Phys Lett 48: 442-444.

Dong et al. (2015). Recovery of platinum group metals from spent catalysts: a review. International Journal of Mineral Processing; 145, 108-13.

Eliaz, N. et al. (2000). Hydrogen-assisted processing of materials. Materials Science and Engineering A289:41-53.

Firdaus, M. et al. (2016). Review of high-temperature recovery of rare earth (Nd/Dy) from magnet waste. Journal of Sustainable Metallurgy, 2(4), 276-295.

Fornalczyk A. (2012). Industrial catalysts as a source of valuable metals. JAMME; 55(2), 864-68.

Fornalczyk et al. (2009). Removal of platinum group metals from the used auto catalytic converter. Metalurgija: 48(2), 133-6.

Gupta, C.K. et al. (2005). Extractive Metallurgy of Rare Earths (CRC Press, London, New York), p. 506.

Hagelüken BC. (2012). Recycling the platinum group metals: a European perspective. Platinum Metals Review;56(1), 29-35.

Harris, I. R. et al. (1985). The hydrogen decrepitation of an Ndi15Fe77B8 magnetic alloy. Journal of the Less Common Metals, 106(1), L1-L4.

Harris, I. R. et al. (1991). Hydrogen: its use in the processing of NdFeB-type magnets. Journal of the Less common Metals, 172, 1273-1284.

Hoffmann J.E. (1988). Recovery of platinum-group metals from gabbroic rocks metals from auto catalysts. JOM;40(6):40-4.

(56) References Cited

OTHER PUBLICATIONS

Horiuchi, K. et al. (2017). Investigation of heating conditions for cobalt recycling from spent lithium ion batteries by magnetic separation. Kagaku Kogaku Ronbunshu, 43(4), 213-218.
Hu, J. et al. (2017). A promising approach for the recovery of high value-added metals from spent lithium-ion batteries. Journal of Power Sources, 351, 192-199,.
Isnard, O. et al. (1995). Neutron-diffraction study of the insertion scheme of hydrogen in Nd2Fe14B. Journal of applied physics, 78(3), 1892-1898.
Itakura, T. et al. (2006). Resource recovery from Nd—Fe—B sintered magnet by hydrothermal treatment. Journal of Alloys and Compounds, 408, 1382-1385.
Itoh, M. et al. (2009). Novel rare earth recovery process on Nd—Fe—B magnet scrap by selective chlorination using NH4Cl. Journal of Alloys and Compounds, 477(1-2), 484-487.
Jha et al. (2013). Hydrometallurgical recovery/recycling of platinum by the leaching of spent catalysts: A review. Hydrometallurgy;133:23-32.
Kamimoto, Y. et al. (2018). Electrodeposition of rare-earth elements from neodymium magnets using molten salt electrolysis. Journal of Material Cycles and Waste Management, 20(4), 1918-1922.
Kaplan, V. et al. (2021). Using Chlorine Gas to Recover Rare Earth Metals from End-of-Life Permanent Magnets. JOM, 73(6), 1957-1965.
Khaliq, A. et al. (2014)-Metal extraction processes for electronic waste and existing industrial routes: a review and Australian perspective-Resources, 3(1), 152-179.
Kim et al. (2000). Effects of carbon monoxide addition to chlorine plasma-treated platinum films. Applied surface science;156(1-4), 9-15.
Kim et al. (2004). A process for extracting precious metals from spent printed circuit boards and automobile catalysts. JOM;56(12), 55-8.
Zheng, X. et al. (2018). A mini-review on metal recycling from spent lithium ion batteries. Engineering, 4(3), 361-370.
Meakin, J. P. et al. (2016). 3-D laser confocal microscopy study of the oxidation of NdFeB magnets in atmospheric conditions. Applied Surface Science, 378, 540-544.
Menad, N. et al. (2017). Characteristics of Nd—Fe—B Permanent Magnets Present in Electronic Components. Int J Waste Resour, 7(263), 2.
Meyer, G. (2007). The Reduction of Rare-Earth Metal Halides with Unlike Metals—Wöhler's Metallothermic Reduction. Zeitschrift für anorganische und allgemeine Chemie, 633(15), 2537-2552.
Meyer, G. et al. (1986). The metallothermic reduction of several rare-earth trichlorides with lithium and sodium. Journal of the Less Common Metals, 116(1), 187-197.
Ojeda et al. (1999). Recovery of palladium from an exhausted catalyst by chlorination: effect of carbon content and thermal treatment. Transactions of the Institution of Mining and Metallurgy. Section C. Mineral Processing and Extractive Metallurgy; 108.
Okabe, T. H. et al. (2003). Direct extraction and recovery of neodymium metal from magnet scrap. Materials Transactions, 44(4), 798-801.
Önal, M.A.R. (2017). Recycling of NdFeB magnets for rare earth elements (REE) recovery. (REE) recovery. Retreived from https://www.mtm.kuleuven.be/onderzoek/Semper/Hitemp/publications/doctoral-theses/Recaional.
Önal, M.A.R. et al. (2017). Comparative oxidation behavior of Nd—Fe—B magnets for potential recycling methods: Effect of hydrogenation pre-treatment and magnet composition. Journal of Alloys and Compounds, 728, 727-738.
Osborn, J. A. (1945). Demagnetizing factors of the general ellipsoid. Physical review, 67(11-12), 351.
Park et al. (1996). Platinum Etching in an Inductively Coupled Plasma. In Solid State Device Research Conference, ESSDERC'96. Proceedings of the 26th European (pp. 631-634). IEEE.
Pathak, A. K. et al. (2015). Cerium: an unlikely replacement of dysprosium in high performance Nd—Fe—B permanent magnets. Advanced Materials, 27(16), 2663-2667.
Peelman, S. et al. (2018). Recovery of REEs from End-of-Life Permanent Magnet Scrap Generated in WEEE Recycling Plants. In Extraction 2018 (pp. 2619-2631). Springer, Cham.
Pietrelli et al. (2013). Automotive spent catalysts treatment and platinum recovery. International Journal of Environment and Waste Management, 1;11(2):222-32.
Saguchi, A. et al. (2002). Recycling of rare earth magnet scraps part III carbon removal from Nd magnet grinding sludge under vacuum heating. Materials transactions, 43(2), 256-260.
Saguchi, A. et al. (2006). Recycling of rare earth magnet scraps: Carbon and oxygen removal from Nd magnet scraps. Journal of alloys and compounds, 408, 1377-1381.
Sato, N. et al. (1998). Recovery of samarium and neodymium from rare earth magnet scraps by fractional crystallization method. Metallurgical Review of MMIJ (Mining and Metallurgical Institute of Japan), 15(1), 1-13.
Schwartz, H. (1997). Prokon Showme Software. The Calculation Companion.
Shelepchikov, A. et al. (2008). Organohalogen Compd. 70, 1950-1953.
Sheridan, R. S. et al. (2012). Anisotropic powder from sintered NdFeB magnets by the HDDR processing route. Journal of Magnetism and Magnetic Materials, 324(1), 63-67.
Shirayama, S. et al. (2018). Selective extraction and recovery of Nd and Dy from Nd—Fe—B magnet scrap by utilizing molten MgCl 2. Metallurgical and Materials Transactions B, 49(3), 1067-1077.
Takeda, O. et al. (2014). Recycling of rare earth magnet waste by removing rare earth oxide with molten fluoride. Materials Transactions, 55(2), 334-341.
Uda, T. (2002). Recovery of rare earths from magnet sludge by FeCl2. Materials Transactions, 43(1), 55-62.
Venkatesan, P. et al. (2018). Selective extraction of rare-earth elements from NdFeB magnets by a room-temperature electrolysis pretreatment step. ACS Sustainable Chemistry & Engineering, 6(7), 9375-9382.
Vogel, H. et al. (2015). Development and research trends of the neodymium electrolysis—a literature review. In Proceedings of the 8th European metallurgical conference, Duesseldorf. 1-13 .
Walton, A. et al. (2015) The use of hydrogen to separate and recycle neodymium-iron-boron-type magnets from electronic waste. Journal of Cleaner Production 104:236-241.
World Chlorine Council, Chlorine Safety Scrubbing System, April, 2-47 (2011).
Xiaowen, Y. et al. (2014). Recycle rare earth elements from NdFeB waste with oxalate precipitation method. Chinese Journal of Rare Metals. 38, 6. 1093-1098. (Abstract only).
Yang, Y. et al. (2017). REE recovery from end-of-life NdFeB permanent magnet scrap: a critical review. Journal of Sustainable Metallurgy, 3(1), 122-149.
Yin, M. et al. (2014). Recycle Rare Earth Elements from NdFeB Waste with Oxalate Precipitation Method. Chinese Journal of Rare Metals 38(6): 1093-1098. (Abstract).
Yoo, J.S. (1998). Metal recovery and rejuvenation of metal-loaded spent catalysts. Catalysis Today;44(1-4):27-46.
Yu, Yong, et al. (2011). Progress of Platinum Group Metals Recovery from Spent Carrier Catalysts [J]. Hebei Chemical Industry 2.
Zakotnik, M. et al. (2008). Possible methods of recycling NdFeB-type sintered magnets using the HD/degassing process. Journal of Alloys and Compounds, 450(1-2), 525-531.
Zakotnik, M. et al. (2009). Multiple recycling of NdFeb-type sintered magnets. Journal of Alloys and Compounds, 469(1-2), 314-321.
Zeng et al. (2012). Current status and future perspective of waste printed circuit boards recycling. Procedia Environmental Sciences; 16:590-7.
Kamimoto, Y. et al. (2018). Electrodeposition of rare-earth elements from neodymium magnets using molten salt electrolysis. Journal of Material Cycles and Waste Management, 20, 1918-1922.

(56) References Cited

OTHER PUBLICATIONS

Moosa, I. S. (2016). Hydrogen decrepitation (HD), history and applications in the production of permanent magnets. International Journal of Advanced Research in Engineering and Technology (IJARET), 7(5), 37-44.
Rangelova, V. et al. (2020). Effect of hydrogen induced decrepitation on the hydrogen sorption properties of MmNi5. International journal of electrochemical science, 15(6), 4900-4907.
Mochizuki, Y. et al. (2013). Selective recovery of rare earth elements from Dy containing NdFeB magnets by chlorination. ACS Sustainable Chemistry & Engineering, 1(6), 655-662.
Tejada, J., Hernandez, J. M., Duran, M., Krotenko, E., Morenza, J. L., Sardin, G., & Chudnovsky, E. M. (1999). The effect of hydrogen on the magnetic properties of the Nd—Fe—B—H compound. *Journal of magnetism and magnetic materials*, 195(2), 476- 482.

* cited by examiner

1 – Electrolytic bath, 2 – Titanium Cathode, 3 – Magnet pieces, 4 – Titanium Grid, 5 – Nickel Anode, 6 – KOH solution, 7 – Fragmented magnet powder.

1 – chlorine generator; 2 – gas stop; 3 – valve; 4 – flowmeter; 5 – tube for chlorine; 6 – place for air addition; 7 – quartz reactor; 8 – furnace with temperature controller; 9 – Pyrex glass crucible; 10 – gas cleaning bottle, 11 – sublimate collector, 12 – sublimates.

RECOVERY OF RARE EARTH METALS FROM FERROMAGNETIC ALLOYS

CROSS-REFERENCE TO RELATED APPLICATIONS

This application is a Continuation-in-Part of PCT International Application No. PCT/IL2021/050811, International Filing Date Jul. 1, 2021, claiming the benefit of U.S. Patent Application No. 63/046,727, filed Jul. 1, 2020, which are hereby incorporated by reference.

FIELD OF THE INVENTION

This invention is directed to methods for recovery of at least one rare earth metal from ferromagnetic alloy, including a chlorination of the rare earth metal following by separation of the chlorinated product.

BACKGROUND OF THE INVENTION

Rare earth magnets based upon neodymium-iron-boron (NdFeB) are employed in many clean energy and high-tech applications, including hard disk drives (HDDs), motors in electric vehicles and electric generators in wind turbines. In recent years, the supply of rare earth metals has come under considerable strain. This resulted in dramatic price fluctuations for the rare earth metals, in particular, neodymium, praseodymium and dysprosium, the rare earth constituents of NdFeB magnets. According to the EU Critical Materials list (2010, 2014) and the US Department of Energy's energy critical element list (2010), the rare earth metals are classified as at greatest risk of supply shortages compared to those of all other materials used for clean energy technologies.

There are several ways in which these material shortages could be addressed including: (a) opening more rare earth mines, (b) using alternative technologies which do not contain rare earths (c) reducing the amount of rare earth metal used in particular applications such as magnets or (d) recycling the existing stock of magnets containing rare earth metals with various types of equipment. However, with regard to option (a), the mining, beneficiation and separation of rare earth elements is energy intensive, results in toxic by-products from acid leaching processes and the primary ores are nearly always mixed with radioactive elements such as thorium. If alternative technologies are employed, as in option (b) or reduction of rare earth metal quantities as in option (c), compared to permanent magnet machines, this often leads to a drop in efficiency and performance.

Recycling of magnet scrap from waste products consists of multiple steps, including preliminary steps; separation of the magnets from the waste product, demagnetization through heat treatment at 300-350° C., decarbonization (for removal of resin) by combustion at 700-1000° C. under air or oxygen flow, and deoxidization by hydrogen reduction [1-3]. The main process (separation of rare earth metals and iron) begins after these preliminary stages. Several wet processes: acid dissolution [4], solvent extraction, and the oxalate method [5] are used too for recovery of the neodymium. These wet chemical methods have poor yield from the acid dissolution and effluent treatment steps, which requires a multiple-step process resulting in high cost. It is important that the recovery process for the rare earth metals from magnet scrap has as low cost and as few steps as possible, because recovery of the magnets from the product is itself a multi-step process.

Several works were carried out on the chlorination of magnets with various reagents: $NH_4Cl$ [6], $FeCl_2$ [7], $MgCl_2$ [8], and chlorine gas with carbon [9]. The use of $NH_4Cl$, $FeCl_2$, and $MgCl_2$ as chlorinators led to the formation of neodymium chloride and iron and boron alloy remained in the solid metallic form. The resulting mixture of the neodymium chloride and Fe—B metal residue was then separated by vacuum distillation or magnetic separation. The chlorination method is low-cost, simplifies the overall process, and reduces the amount of effluent requiring treatment as a dry process. A method for chlorinating magnets with chlorine and carbon addition at a temperature of 100-1000° C. with preliminary oxidation treatment was proposed in [9].

It was shown that preliminary oxidation sintering in an air stream with the conversion of all metals to oxides ($Fe_2O_3$, $FeNdO_3$, $Nd_2O_3$) dramatically reduces the degree of sublimation of iron and boron during chlorination with pure chlorine. When carbon is added to the chlorination process (carbochlorination process), the degree of sublimation of iron and boron chlorides increases. It is known [10] that the Gibbs energy of the chlorination reaction of metal oxides by chlorine gas is a significant positive value; therefore, successful chlorination of them with pure chlorine is practically impossible. Chlorination of metal oxides showed to be effective with the addition of a reducing agent and the addition of carbon during the chlorination of oxides which dramatically increased the efficiency of the chlorides sublimation process [10].

One of the biggest challenges associated with the recycling of magnets is how to separate efficiently the magnets from the other components.

SUMMARY OF THE INVENTION

In some embodiment, this invention provides a method of atomic hydrogen decrepitation of a ferromagnetic alloy, wherein the method comprises an electrolytic reaction of a ferromagnetic alloy by atomic hydrogen at room temperature, wherein the atomic hydrogen is released from a cathode within an electrolytic cell and reacts with the ferromagnetic alloy to obtain a ferromagnetic alloy powder having grain size ≤50 μm.

In some embodiment, this invention provides a method for recovery of at least one rare earth metal from ferromagnetic alloy, the method comprises:

Pre-treating a ferromagnetic alloy by atomic hydrogen decrepitation as described herein to form a powder alloy;

(a) reacting the ferromagnetic powder alloy with at least one chlorine-containing gas to obtain a volatile iron-containing chloride product and non-volatile at least one rare earth metal chloride;

(b) providing air flow to said volatile iron-containing chloride product, thereby oxidizing the iron-containing chloride product to iron oxide;

(c) separating said iron oxide product and non-volatile at least one rare earth metal chloride;

(d) cooling said separated non-volatile at least one rare earth metal chloride;

(e) electrolyzing said cooled non-volatile at least one rare earth metal chloride; thereby recovering said at least one rare earth metal.

This invention provides a method for recovery of at least one rare earth metal from a ferromagnetic alloy, the method comprises:

(a) reacting a ferromagnetic alloy with at least one chlorine-containing gas to obtain a volatile iron-containing chloride product and non-volatile at least one rare earth metal chloride;

(b) providing air flow to said volatile iron-containing chloride product, thereby oxidizing the iron-containing chloride product to iron oxide;

(c) separating said iron oxide product and non-volatile at least one rare earth metal chloride;

(d) cooling said separated non-volatile at least one rare earth metal chloride;

(e) electrolyzing said cooled non-volatile at least one rare earth metal chloride; thereby recovering said at least one rare earth metal.

This invention provides at least one rare earth metal composition prepared by the methods of this invention.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

—FIG. 4A: sample 1; FIG. 4B: sample 2. (The contents of samples 1 and 2 are provided in Example 3, Table 3).

FIG. 12A)—Photograph; FIG. 12B)—SEM image, scale bar 20μm; c) EDS spectrum. The carbon peak in panel FIG. 12C) (marked **) is not due to the powder, but rather to the thin carbon support foil. REE indicates overlapping XRF peaks of the rare earth elements.

FIGS. 14A and 14B present Magnetic polarization J[T]; FIG. 14C presents magnetic energy density |BH| [Joule/$m^3$], magnetic induction B[T].

Figure 1:
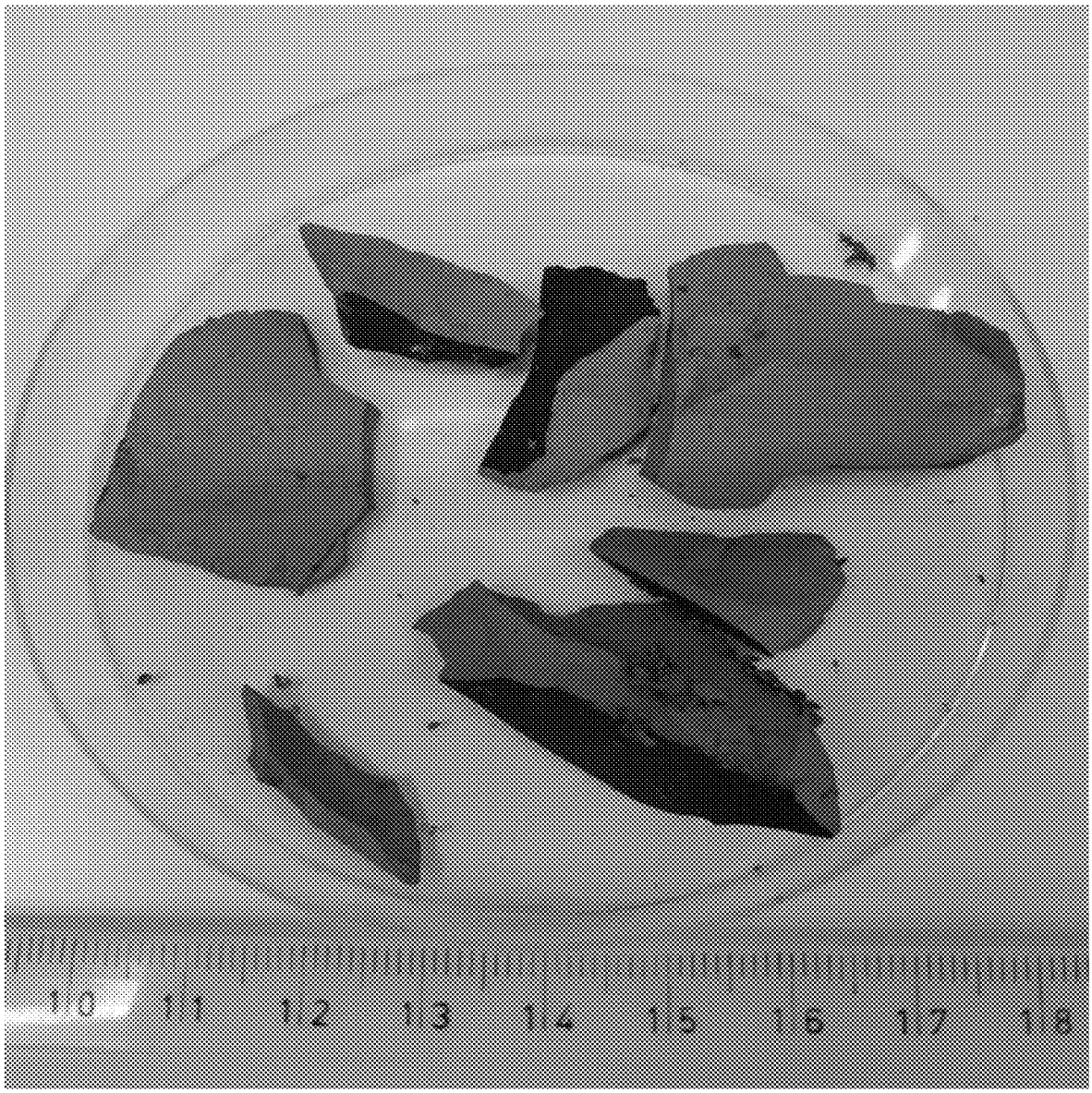
FIG. 1 shows the ferromagnetic alloy before atomic hydrogen decrepitation.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

This invention provides a method for recovery of at least one rare earth metal from a ferromagnetic alloy, the method comprises:

(a) reacting a ferromagnetic alloy with at least one chlorine-containing gas to obtain a volatile iron-containing chloride product and non-volatile at least one rare earth metal chloride;

(b) providing air flow to said volatile iron-containing chloride product, thereby oxidizing the iron-containing chloride product to iron oxide;

(c) separating said iron oxide product and non-volatile at least one rare earth metal chloride;

(d) cooling said separated non-volatile at least one rare earth metal chloride;

(e) electrolyzing said cooled non-volatile at least one rare earth metal chloride; thereby recovering said at least one rare earth metal.

In some embodiments, the method of this invention comprises prior to reacting the ferromagnetic alloy with at least one chlorine-containing gas of step (a), a pre-treatment of the ferromagnetic alloy by decrepitation to form a powder alloy using atomic hydrogen decrepitation treatment. In other embodiments, the decrepitation is performed at room temperature. In other embodiment, the atomic hydrogen decrepitation treatment is performed using electrolysis. In other embodiments, the electrolysis is performed using a first electrode (cathode) of copper, nickel, steel, titanium or combination thereof; and a second electrode (anode) of lead, nickel, steel or combination thereof. In other embodiments, the ferromagnetic alloy is attached to said first electrode (cathode).

In some embodiment, this invention provides a method for recovery of at least one rare earth metal from ferromagnetic alloy, the method comprises:

pre-treating a ferromagnetic alloy by atomic hydrogen decrepitation as described herein to form a powder alloy;

(a) reacting the ferromagnetic powder alloy with at least one chlorine-containing gas to obtain a volatile iron-containing chloride product and non-volatile at least one rare earth metal chloride;

(b) providing air flow to said volatile iron-containing chloride product, thereby oxidizing the iron-containing chloride product to iron oxide;

(c) separating said iron oxide product and non-volatile at least one rare earth metal chloride;

(d) cooling said separated non-volatile at least one rare earth metal chloride;

(e) electrolyzing said cooled non-volatile at least one rare earth metal chloride; thereby recovering said at least one rare earth metal.

This invention thus provides a method for recovery of at least one rare earth metal from ferromagnetic alloy, the method comprising: (i) atomic hydrogen decrepitation said ferromagnetic alloy to form a powder alloy; (ii) magnetic separation of said powder to form a powder alloy having a lower iron content; (iii) reacting said powder alloy having a lower iron content with at least one chlorine-containing gas to obtain volatile iron-containing chloride product and non-volatile at least one rare earth metal chloride; (iv) separating said volatile iron-containing chloride product and non-volatile at least one rare earth metal chloride; (v) cooling said separated non-volatile at least one rare earth metal chloride; (vi) electrolyzing said cooled non-volatile at least one rare earth metal chloride; thereby recovering said at least one rare earth metal.

In other embodiments, the atomic hydrogen decrepitation is performed at room temperature. In other embodiment, the atomic hydrogen decrepitation is performed using electrolysis. In other embodiments, the electrolysis is performed using a first electrode (cathode) of copper, nickel, steel, titanium, or combination thereof, and a second electrode (anode) of lead, nickel, steel or combination thereof. In other embodiments, the ferromagnetic alloy is attached to said first electrode (cathode).

This invention also provides a method for recovery of spent neodymium magnets by chlorine treatment that does not require pre-treatment of magnets. These magnets were used without demagnetization, crushing and milling. After treatment at 400° C., a clinker consisting of rare earth metals chlorides and sublimates consisting of iron oxide and iron chlorides were obtained. The resulting rare earth metals chlorides can be easily processed by electrolysis of the molten salts for rare earth metals production [12, 13].

When referring to a ferromagnetic (can be used interchangeably with ferrimagnetic) alloy it should be understood to encompass any type of source (including spent) of permanent magnet made of a combination of metals that creates its own persistent magnetic field. These metals include, but are not limited to the elements iron, nickel and cobalt, rare-earth metals, naturally occurring minerals (such as lodestone) and any combination thereof. In another embodiment, the ferromagnetic alloy is $Nb_2Fe_{14}B$, (Nb,Pr) $Fe_{14}B$ with $Dy_2O_3$ additions.

In some embodiments, said at least one rare earth metal is selected from cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb), and yttrium (Y).

Atomic Hydrogen Decrepitation

Gaseous hydrogen absorption behavior of the Nd-magnets was reported. $Nd_{15}Fe_{77}B_8$ alloy was found to absorbs hydrogen very readily at room temperature (provided that the surface is not heavily oxidized), with consequent decrepitation (pulverization) of the bulk material into a friable powder. Absorption was shown to proceed in two stages: hydrogen is first absorbed by the Nd-rich grain boundary material and then by the matrix Nd—Fe—B phase [20, 21]. Due to the large electronegativity difference, insertion of hydrogen is favored in the neighborhood of the rare earth elements (REE). Inter grain failure may produce single crystal particles; however, these particles are nevertheless brittle and amenable to further reduction in size by ball milling [22].

This invention is directed to a method of decrepitation of a ferromagnetic alloy using atomic hydrogen, as opposed to gaseous hydrogen. The advantage of using atomic hydrogen compared to gaseous hydrogen is the mild conditions, wherein the reaction is conducted at room temperature and it eliminates the need of pure hydrogen at high pressure.

In some embodiments, the methods of this invention comprise an atomic hydrogen decrepitation of a ferromagnetic alloy, wherein the method comprises an electrolytic reaction of the ferromagnetic alloy by atomic hydrogen at room temperature, wherein the atomic hydrogen is released from a cathode within an electrochemical cell and reacted with the ferromagnetic alloy to obtain a ferromagnetic alloy powder having grain size ≤50 μm.

In some embodiments, the methods of this invention comprise an atomic hydrogen decrepitation of a ferromagnetic alloy, wherein the method comprises an electrolytic reaction of the ferromagnetic alloy by atomic hydrogen at room temperature, wherein the atomic hydrogen is released from a cathode within an electrochemical cell and reacted with the ferromagnetic alloy to obtain a ferromagnetic alloy powder having grain size ≤50 μm, wherein the ferromagnetic alloy is attached to a cathode.

In some embodiments, the methods of this invention comprise an atomic hydrogen decrepitation of a ferromagnetic alloy, wherein the method comprises an electrolytic reaction of the ferromagnetic alloy by atomic hydrogen at room temperature, wherein the atomic hydrogen is released from a cathode within an electrochemical cell and reacted with the ferromagnetic alloy to obtain a ferromagnetic alloy powder having grain size ≤50 μm, wherein the atomic hydrogen is released from the cathode by a reduction reaction of $2H^+(aq)+2e^- \rightarrow 2H(g)$. In other embodiments, the H+ is a result of electrolysis of the water ($H_2O$) within the electrolytic cell.

In other embodiment, the atomic hydrogen further forms a gaseous hydrogen ($H_2$) [2H (g)→$H_2$ (g)] in the water electrolytic bath. Atomic hydrogen forms on the metal surface at the cathode and reacts with the ferromagnetic alloy. Its remainder goes into water solution and forms molecular hydrogen.

In other embodiments, the cathode comprises copper, nickel, steel, titanium or any combination thereof. In another embodiment, the anode comprises lead, nickel, steel or combination thereof.

In some embodiment, the atomic hydrogen decrepitation comprises an electrolytic reaction, wherein the electrolyte is a KOH or NaOH aqueous solution.

In some embodiment, the atomic hydrogen decrepitation comprises an electrolytic reaction, wherein the electrolytic reaction is conducted at room temperature. In another embodiment, the temperature is between 20 to 40° C. deg. In another embodiment, the electrolytic reaction is between 20 to 30° C. deg. In another embodiment, the electrolytic reaction is between 20 to 35° C. deg.

In some embodiment, the atomic hydrogen decrepitation comprises an electrolytic reaction, wherein the applied potential is between 4-10 V. In another embodiment the applied potential is between 4-8 V. In another embodiment the applied potential is 4, 5, 6, 7, 8, 9, 10 and any ranges thereof.

This process eliminates the need for high temperature equipment or for pure hydrogen atmosphere at high pressure. The fine grain NdFeB hydride powder may be processed further to form new magnetic materials or to facilitate separation of the valuable rare earth metals from the iron-containing components of the magnet In some embodiment, the atomic hydrogen decrepitation comprises an electrolytic reaction, wherein the electrolytic reaction is performed in a period of between 30 min to 3 hrs. In another embodiment, the electrolytic reaction is performed in 2 hrs.

In some embodiment, the ferromagnetic alloy powder obtained by the atomic hydrogen decrepitation method of this invention has a grain size ≤50 μm. In other embodiments, the grain size is between 1 μm to 50 μm. In other embodiments, the grain size is between 10 μm to 50 μm. In other embodiments, the grain size is between 30 μm to 50 μm. In other embodiments, the grain size is between 10 μm to 40 μm. In other embodiments, the grain size is between 10 μm to 30 μm.

Chlorination

In some embodiments, the methods of this invention comprises a reaction with at least one chlorine-containing gas (step (a) or step (iii)). In other embodiments, the reaction is performed at a temperature of between 400° C. and 450° C.

In some embodiments, the at least one chlorine-containing gas which is used in the methods of this invention (step (a) or step (iii)) is present in an amount of 0.5-2.0 kg of the chlorine per 1 kg of the ferromagnetic alloy (or powder alloy).

The method according to any one of the preceding claims, wherein said air flow to the volatile iron-containing chloride product of step (b) is present in an amount of 0.5-2.0 kg of the air per 1 kg of the volatile iron-containing chloride product.

In other embodiments, the chloride product is a highly pure chloride (both purity and yield >95%).

In some embodiments, the methods of this invention comprises a step of electrolyzing the cooled non-volatile at least one rare earth metal chloride (Steps (e), or step (vi)). In other embodiments, the electrolysis is performed using graphite electrodes (cathode, anode). In some further embodiments, said electrolysis is performed at a temperature range of between about 500 to 1500° C. In other embodiments, said electrolysis is performed using potential of between 10 to 15V.

In some embodiments, this invention provides at least one rare earth metal composition prepared by the methods of this invention. The following non-limiting examples are presented in order to more fully illustrate certain embodiments of the invention. They should in no way, however, be construed as limiting the broad scope of the invention. One skilled in the art can readily devise many variations and modifications of the principles disclosed herein without departing from the scope of the invention.

EXAMPLES

Example 1—Magnets Treatment with Atomic Hydrogen—Decrepitation

Figure 2:
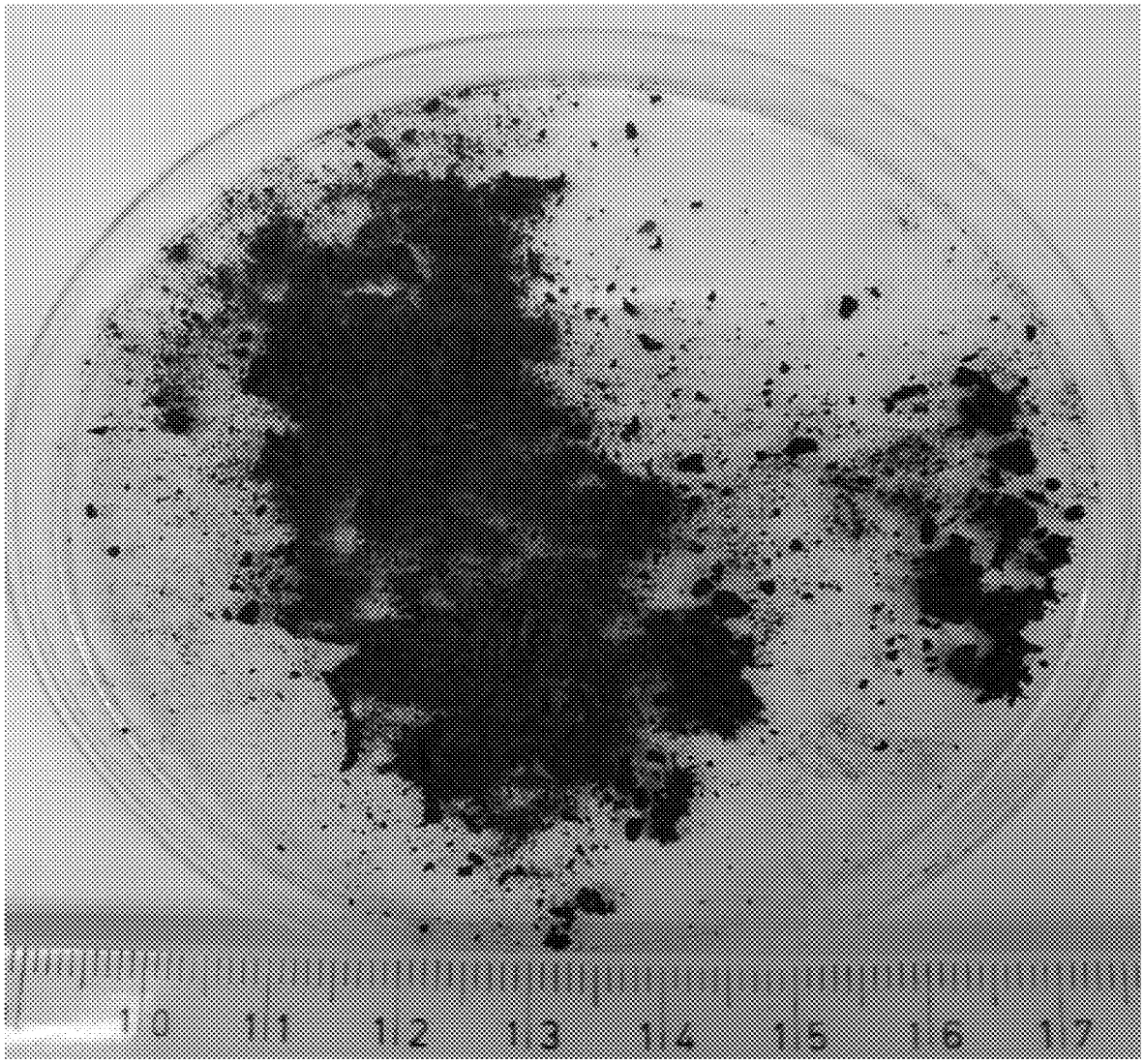
FIG. 2 shows the ferromagnetic alloy after atomic hydrogen decrepitation.
Figure 3:
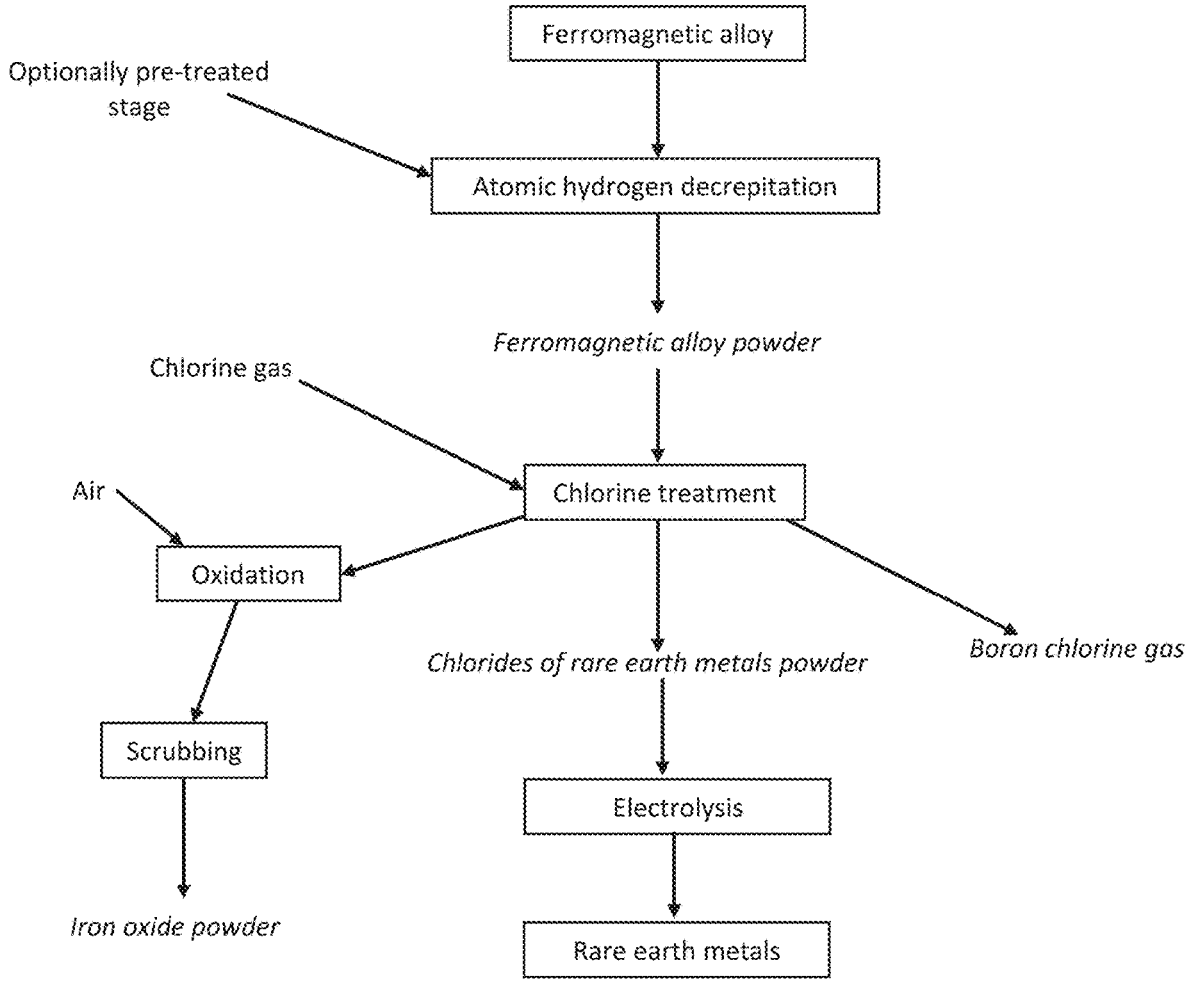
FIG. 3 is a schematic description of the method of the present invention.
Figure 8:
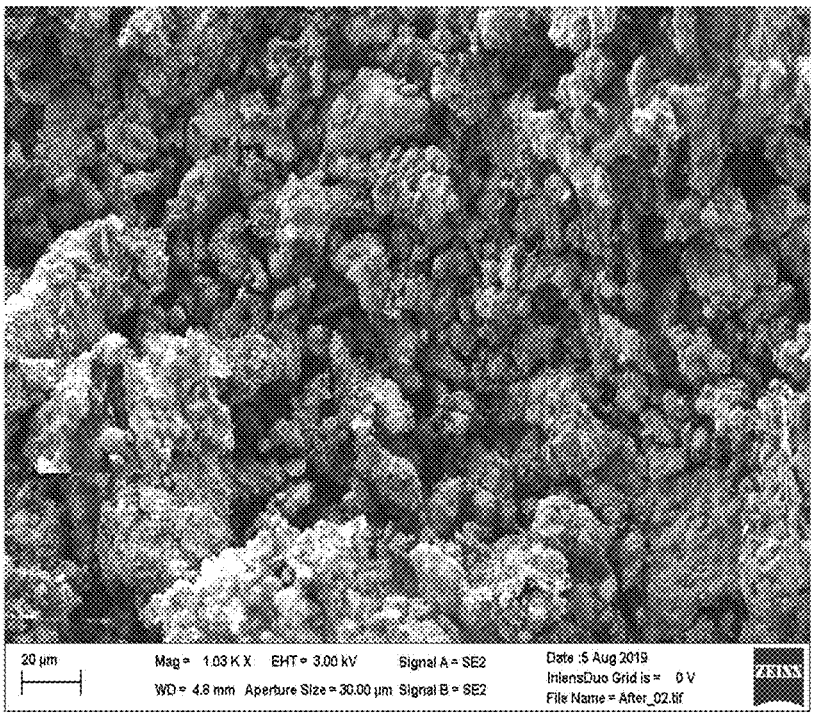
FIG. 8 shows SEM image of the magnet powder after the atomic hydrogen decrepitation.

The decrepitation of the ferromagnetic alloy was carried out in aqueous 1M sodium hydroxide solution at room temperature. Electrolysis was carried out with cathode copper electrode and lead anode electrode. Current density was 0.1 A/cm$^2$. Uncrushed ferromagnetic alloy was attached to the cathode electrode. The atomic hydrogen that is released at the cathode passes through a layer of pieces of a ferromagnetic alloy and reacted with him. The pieces of a ferromagnetic alloy are scattered by atomic hydrogen reaction with ferromagnetic alloy powder production. FIGS. 1, 2 and 8 show the ferromagnetic alloy before and after atomic hydrogen decrepitation.

Characterization of the Initial Magnets.

Used magnet pieces were used as input material.

Content of components presented in the Table 1.

TABLE 1

Content of components in the used magnet pieces.

| | Content (mass %) | | | | |
|---|---|---|---|---|---|
| Sample | Iron | Neodymium | Praseodymium | Dysprosium | Cerium |
| 1 | 64.9 | 24.5 | 8.1 | 4.3 | 0 |
| 2 | 32.8 | 31.8 | 16.7 | 0.8 | 15.4 |

Photo of some magnet pieces is presented in the FIG. 1.

Figure 4A:
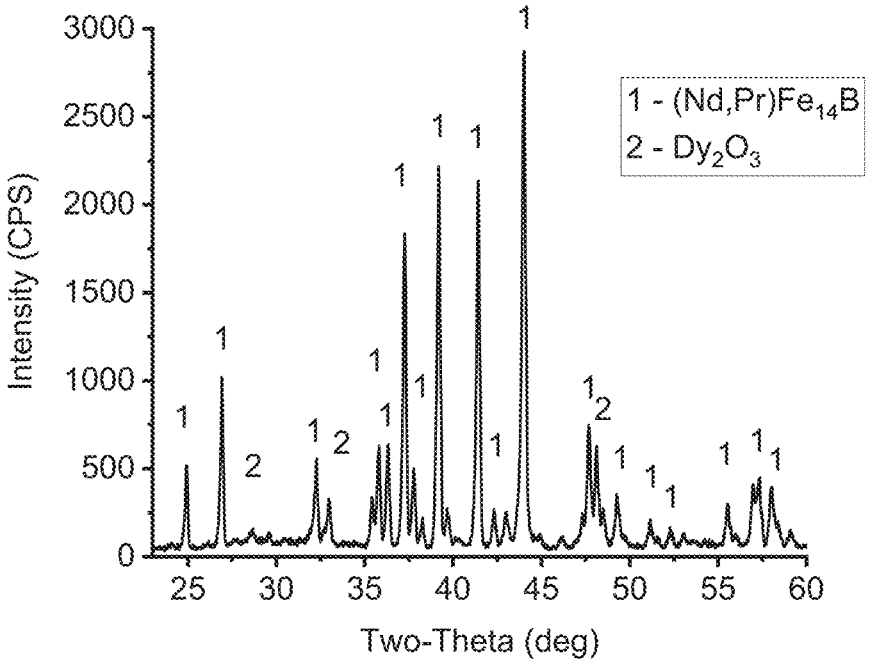
FIGS. 4A and 4B show X-ray diffraction (XRD) of the ferromagnetic alloy (initial magnet) before atomic hydrogen decrepitation

Material X-ray diffraction (XRD) was performed on an Ultima III diffractometer (Rigaku Corporation, Japan) with quantitative phase analysis accomplished using Jade_10 (MDI, Cal.) software and the ICSD database (FIG. 4A).

The composition of the material was characterized by energy dispersive X-ray fluorescence spectroscopy (EDS, LEO Supra) (FIGS. 5A-5D).

Thermodynamic Calculations.

Calculations of Gibbs energy were performed using a computer program and based on standard values for the pure substances [11]. The Gibbs energy (ΔG) in the temperature range 273-473 K is shown in Table 2 for reactions with hydrogen. Group 1—reactions with atomic hydrogen; Group 2—reactions with molecular hydrogen; Group 3—hydrolysis reactions of metal hydrides in the water.

TABLE 2

Gibbs energy (ΔG) calculated for magnet treatment with hydrogen.

| N | Reaction | Temperature, K 273 | 323 | 373 | 423 | 473 |
|---|---|---|---|---|---|---|
| | | ΔG, kJ/mole | | | | |
| | Group 1 | | | | | |
| 1 | Nd (s) + 2H (g) = $NdH_2$ (s) | −572.1 | −560.0 | −547.7 | −535.3 | −522.6 |
| 2 | Pr (s) + 2H (g) = $PrH_2$ (s) | −568.6 | −556.3 | −543.7 | −531.0 | −518.1 |
| 3 | Fe (s) + H (g) = FeH (g) | 212.3 | 208.9 | 205.6 | 202.3 | 199.2 |
| 4 | $Dy_2O_3$ (s) + 6H (g) = 2Dy (s) + $3H_2O$ (l) | −171.9 | −148.0 | −124.3 | −100.9 | −77.7 |
| 5 | $Dy_2O_3$ (s) + 10H (g) = $2DyH_2$ (s) + $3H_2O$ (l) | −1376.5 | −1328.5 | −1280.4 | −1232.1 | −1183.7 |
| | Group 2 | | | | | |
| 6 | Nd (s) + $H_2$ (g) = $NdH_2$ (s) | −163.1 | −155.9 | −148.7 | −141.3 | −133.9 |
| 7 | Pr (s) + $H_2$ (g) = $PrH_2$ (s) | −159.6 | −152.2 | −144.7 | −137.1 | −129.4 |
| 8 | Fe (s) + $0.5H_2$ (g) = FeH (g) | 416.8 | 410.9 | 405.1 | 399.3 | 393.5 |
| 9 | $Dy_2O_3$ (s) + $3H_2$ (g) = 2Dy (s) + $3H_2O$ (l) | 1055.1 | 1064.2 | 1072.8 | 1080.8 | 1088.4 |
| 10 | $Dy_2O_3$ (s) + $5H_2$ (g) = $2DyH_2$ (s) + $3H_2O$ (l) | 668.6 | 691.8 | 714.8 | 737.5 | 759.9 |
| | Group 3 | | | | | |
| 11 | $NdH_2$ (s) + $3H_2O$ (l) = $Nd(OH)_3$ (s) + $2.5H_2$ (g) | −496.6 | −506.0 | −514.8 | −523.2 | −531.1 |
| 12 | $PrH_2$ (s) + $3H_2O$ (l) = $Pr(OH)_3$ (s) + $2.5H_2$ (g) | −413.8 | −423.4 | −432.4 | −440.8 | −448.8 |
| 13 | $DyH_2$ (s) + $3H_2O$ (l) = $Dy(OH)_3$ (s) + $2.5H_2$ (g) | −388.8 | −397.9 | −405.5 | −411.9 | −417.1 |
| 14 | $NdH_2$ (s) + $1.5H_2O$ (l) = $0.5Nd_2O_3$ (s) + $2.5H_2$ (g) | −339.4 | −351.5 | −363.4 | −375.2 | −386.7 |
| 15 | $PrH_2$ (s) + $1.5H_2O$ (l) = $0.5Pr_2O_3$ (s) + $2.5H_2$ (g) | −342.7 | −354.9 | −366.9 | −378.8 | −390.5 |
| 16 | $DyH_2$ (s) + $1.5H_2O$ (l) = $0.5Dy_2O_3$ (s) + $2.5H_2$ (g) | −334.3 | −345.9 | −357.4 | −368.7 | −380.0 |

s—solid, l—liquid, g—gas.

Under the above conditions, the Gibbs energy of the reactions (1, 2) in Group 1 for rare metals were strongly negative (−520-570 kJ/mole).

Thermodynamic calculations predict that the reactions of Nd and Pr from magnets with atomic hydrogen gas can result in the formation of Nd and Pr hydrides within a wide temperature range, including the range of interest 273-373 K. Dysprosium is present in magnets as an additive in the form of oxide $Dy_2O_3$ and can react with atomic hydrogen with metallic dysprosium or $DyH_2$ production (reactions 4, 5). Group 2 includes hydrogen treatment reactions between magnet components and molecular hydrogen. The likelihood of reactions (6, 7) is ensured over the entire temperature range of interest too, with the most negative value being ΔG=−163 kJ/mole for reaction (6). However, the value of Gibbs energy for reactions (6, 7) is much lower than for reactions (1, 2). $Dy_2O_3$ does not react with molecular hydrogen (reactions 8, 9). Iron from a magnet practically does not participate in reactions with hydrogen under our conditions (reactions 3, 8). Group 3 includes hydrolysis reactions of the neodymium, praseodymium, and dysprosium hydrides in the water. Under our conditions, the Gibbs energy of the hydrolysis reactions (11-16) in Group 3 for rare metals is strongly negative (−350-530 kJ/mole). Thermodynamic calculations predict that the hydrolysis reactions of the neodymium, praseodymium, and dysprosium hydrides can result in the formation of Nd, Pr, and Dy hydroxides or oxides within a wide temperature range, including the range of interest 273-373 K.

The chemical decrepitation of magnet described by reactions (1, 2) showing Gibbs energy of −520-570 k/mole, thereby predicting rapid chemical decrepitation of magnet upon atomic hydrogen treatment. $Dy_2O_3$ can react with atomic hydrogen with metallic dysprosium or $DyH_2$ production (reactions 4, 5). These reactions (1, 2, 4, 5) lead to the magnet decrepitation to obtain a magnet powder with a particle size of less than 200 mesh.

Experimental Procedure

Figure 6:
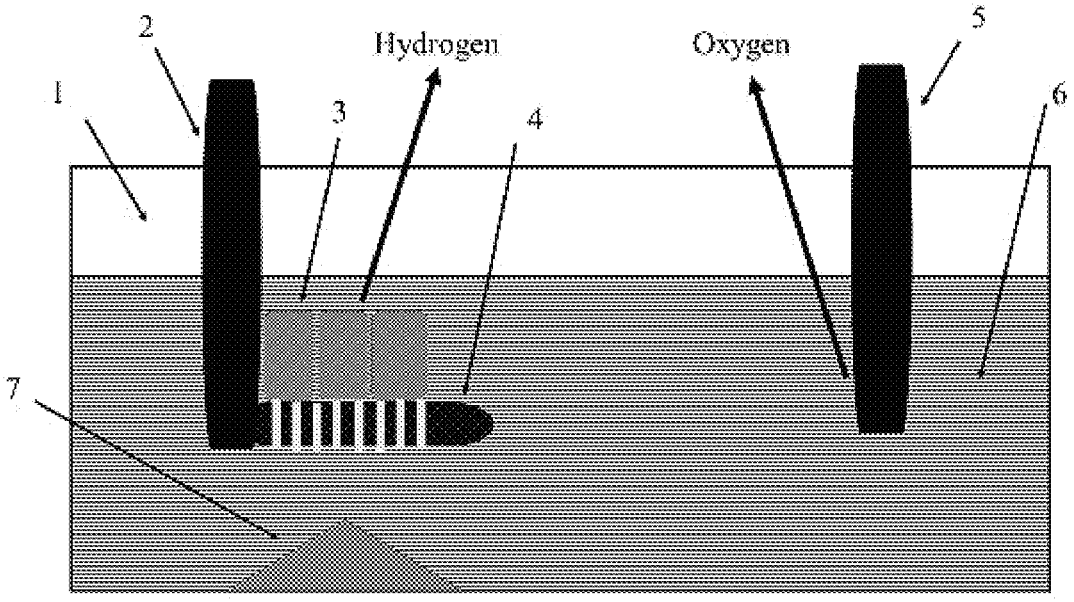
FIG. 6 shows the laboratory setup for the atomic hydrogen decrepitation. 1—Glass vessel containing 700 ml of electrolytic bath, 2—Titanium cathode, 3—Intact magnet fragments, 4—Titanium grid, 5—Nickel anode, 6—1M KOH electrolyte, 7—magnet powder, following decrepitation. 4.7V DC, 13-15 A was applied during 2 hrs under ambient conditions.

The laboratory setup is described in FIG. 6. Test duration was 2-4 hours. Temperature was varied from room temperature to boiling temperature. Potential was 4.7 V, current −13-15 A. Cathode current density was 0.8-0.9 A/$cm^2$.

Figure 7:
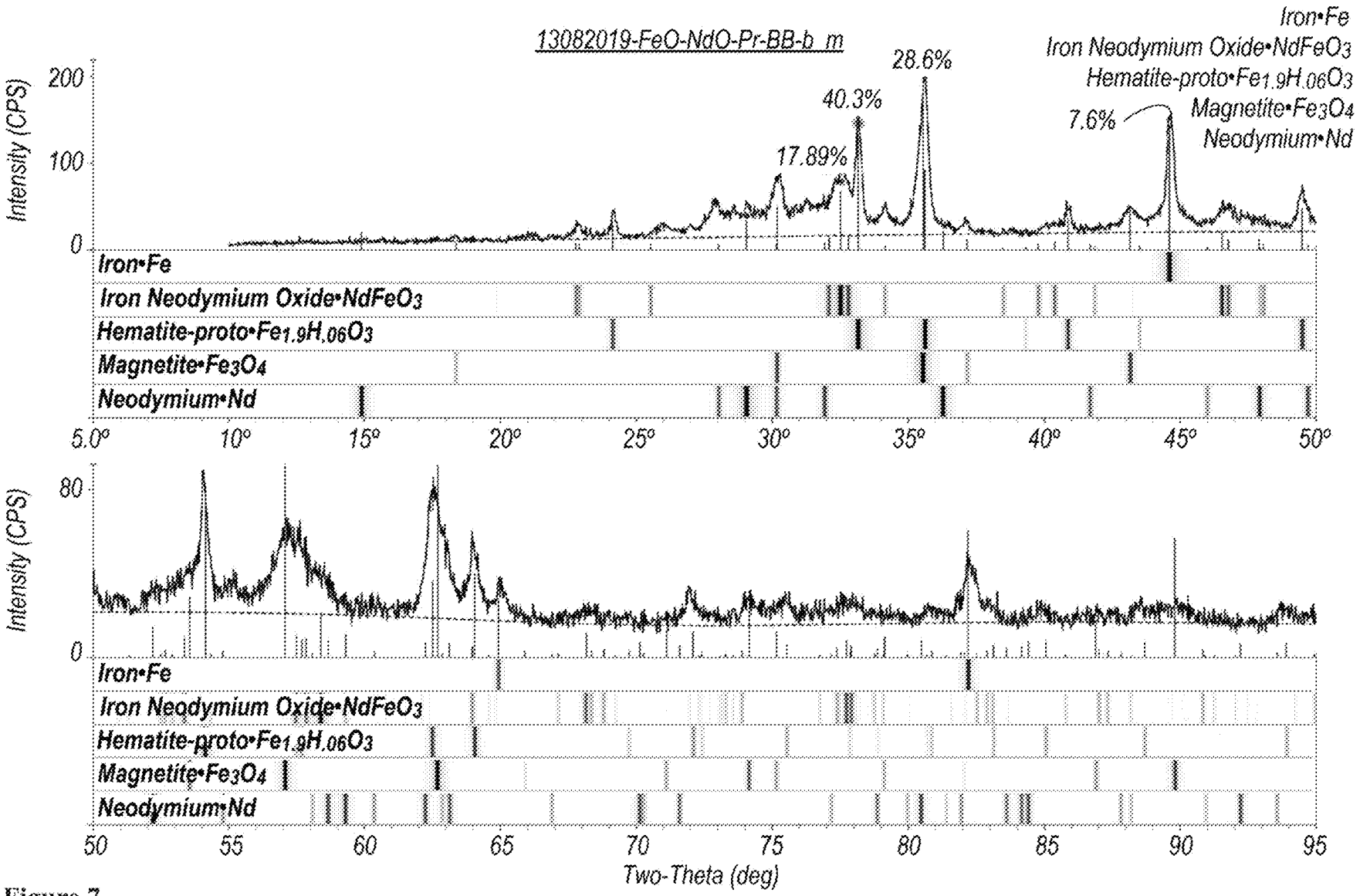
FIG. 7 shows powder X-ray diffraction (XRD) pattern of the magnet powder after atomic hydrogen decrepitation.

Glass with one mole/liter KOH solution was used as electrolytic bath. Titanium was used as cathode, nickel plate—as anode. Pieces (30-40 mm) of the neodymium magnet (as they are, without demagnetization, crushing and milling) were placed on the titanium grid, connected with cathode. Atomic hydrogen, which was emitted during electrolysis, released on the surface of the magnet pieces, and decrepitated them with powder production. Magnet powder passed through the grid and collected at the bottom of the electrolytic bath. FIG. 7 shows the Powder X-ray diffraction (XRD) pattern of the magnet powder after decrepitation; and FIG. 8 shows in a photo and SEM image of the magnet powder after decrepitation.

To summarize, the exposure of as-received Nd-magnet fragments (as prepared according to example 4) to chlorine gas for 2 hrs at 673K leaves highly pure REE (rare earth elements) chlorides (both purity and yield >95%) as the clinker in the laboratory furnace. These chlorides are hygroscopic and readily form the hexahydrate when brought into contact with ambient humidity. The volatile components—particularly those which include Fe or B—are removed from the furnace as sublimated oxychlorides and chlorides. The relative amounts of these products depend on the rate of air flow at the top of the reactor, while the unreacted chlorine gas is recoverable. The presence of high melting temperature oxides following Nd-magnet alloy decrepitation, apparently does not prevent the formation of REE chlorides.

Example 2—Rare-Earth Metal Extraction Including Atomic Hydrogen—Decrepitation Step Treatment of the powder of the ferromagnetic alloy with chlorine gas at 400-450° C. The material was loaded into the reactor. Chlorine was fed into the reactor, heated to a temperature 400-450° C. After the reaction, the chlorides of iron and boron were sublimated and removed from the reactor. Iron chloride was captured in a scrubber with water, and boron chloride was removed with gases. Chlorides of rare earth metals remained in the reactor. Iron-containing chloride vapor product ($FeCl_3$) were received in the scrubber and non-volatile neodymium and praseodymium chlorides ($NdCl_3$, $PrCl_3$) in the reactor.

Example 3—Rare-Earth Metal Extraction without Pre-Treatment of Atomic Hydrogen—Decrepitation In this Example, a process for rare-earth extraction did not require pre-treatment of magnets. The magnets that were used did not include demagnetization, crushing and milling pre-treatments. After treatment at 400° C., a clinker consisting of rare earth metals chlorides and sublimates consisting of iron oxide and iron chlorides were obtained.

Characterization of the Initial Magnets.

Used magnet pieces were used as input material. Content of components presented in the Table 3.

TABLE 3

Content of components in the used magnet pieces.

| | Content (mass %) | | | | |
|---|---|---|---|---|---|
| Sample | Iron | Neodymium | Praseodymium | Dysprosium | Cerium |
| 1 | 64.9 | 24.5 | 8.1 | 4.3 | 0 |
| 2 | 32.8 | 31.8 | 16.7 | 0.8 | 15.4 |

Figure 4B:
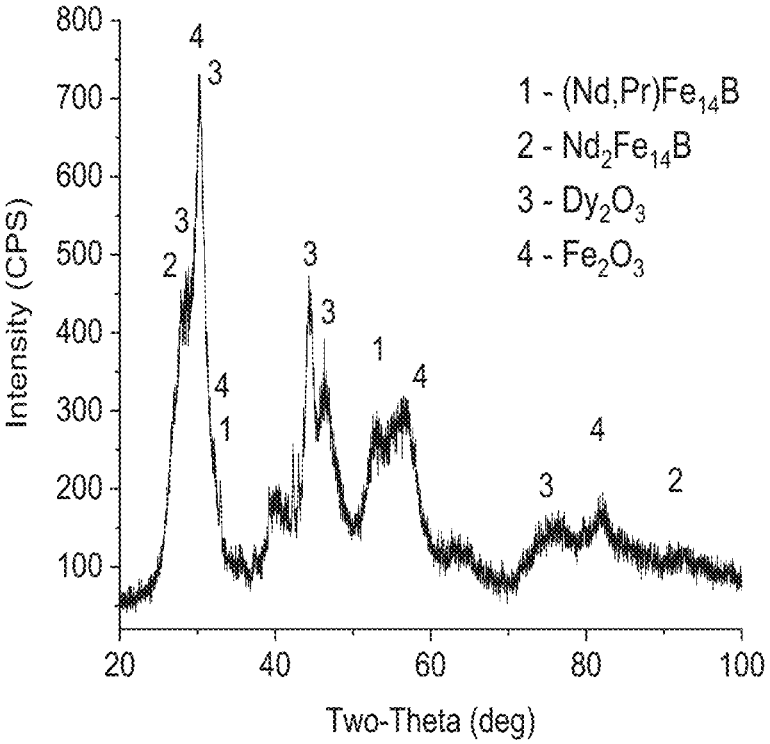
Figure 5A:
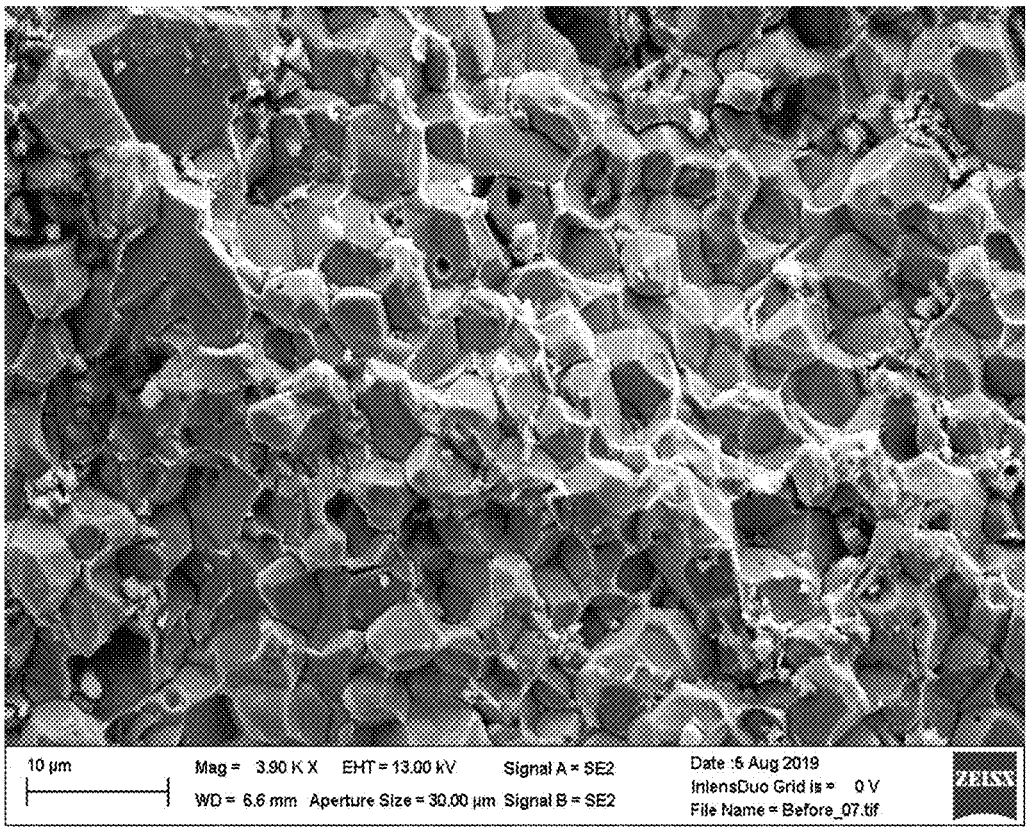
FIGS. 5A-5D present characterization of initial magnet characterized by energy dispersive X-ray fluorescence spectroscopy providing SEM image of the initial magnet 1 (FIG. 5A); SEM image of the initial magnet 2 (FIG. 5B); EDS spectrum of the initial magnet—Sample 1 (FIG. 5C); and EDS spectrum of the initial magnet—Sample 2 (FIG. 5D).
Figure 5B:
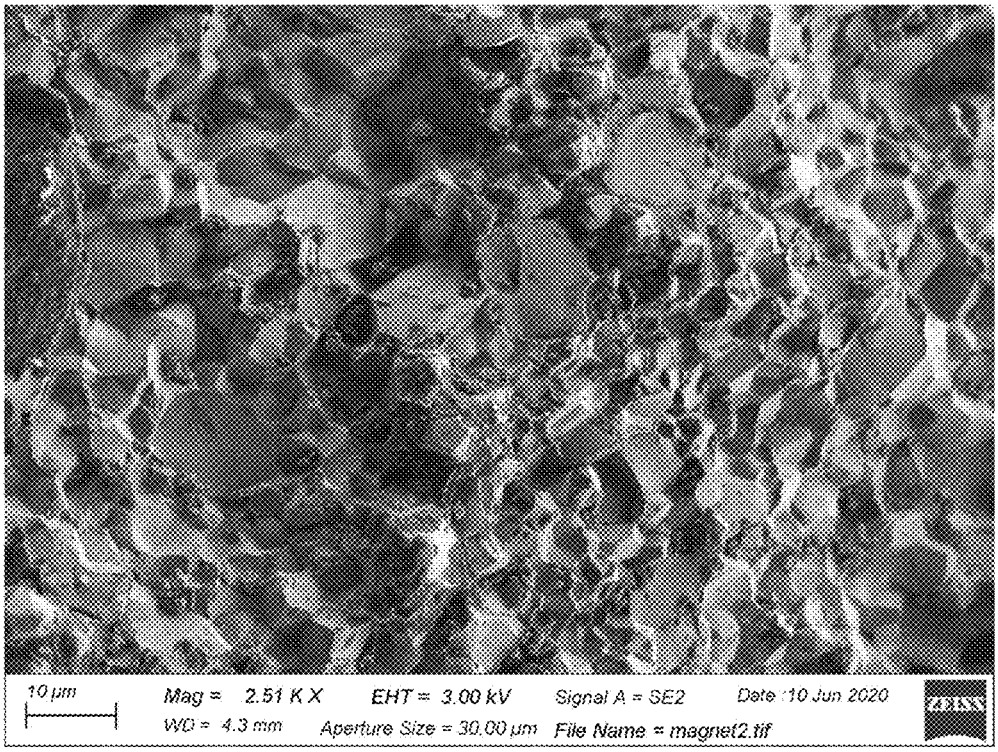
Figure 5C:
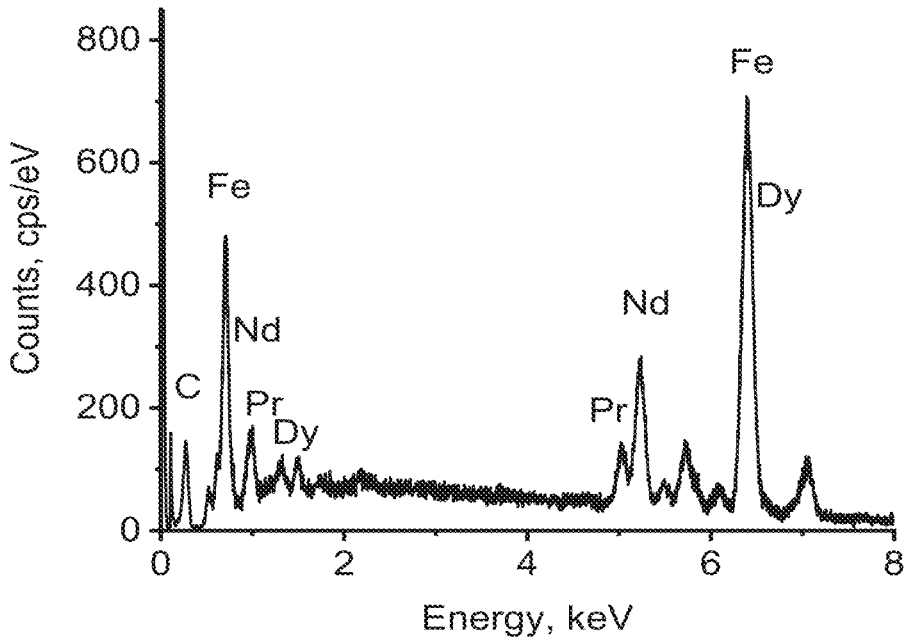
Figure 5D:
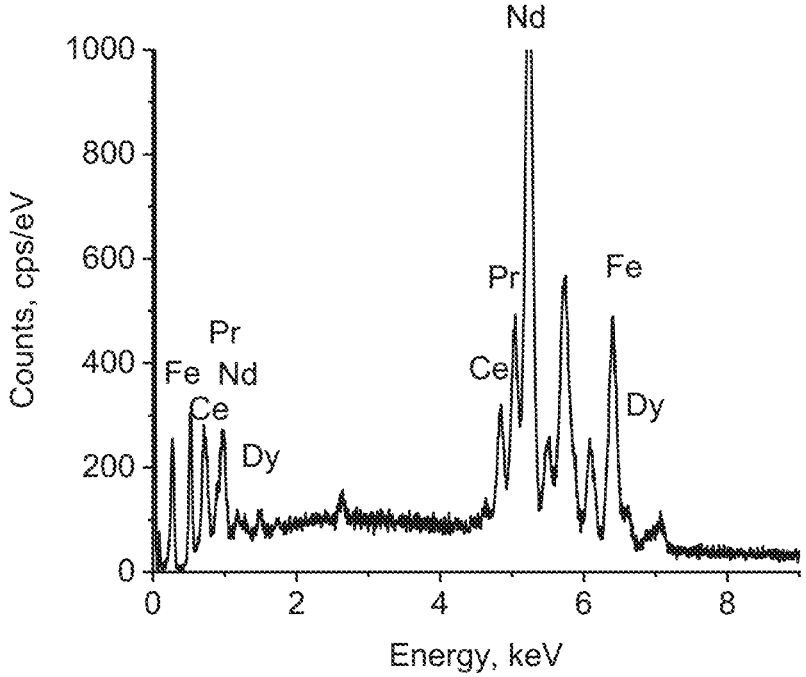

Material X-ray diffraction (XRD) was performed on an Ultima III diffractometer (Rigaku Corporation, Japan) with quantitative phase analysis accomplished using Jade_10 (MDI, Cal.) software and the ICSD database (FIGS. 4A and 4B).

The composition of the material was characterized by energy dispersive X-ray fluorescence spectroscopy (EDS, LEO Supra) (Table 3 and FIGS. 4A and 4B).

Table 3 shows that both magnets are made up of the same elements, but the relationships between the elements are rather different. According to X-ray diffraction patterns, the first sample (FIG. 4A) is a well-crystalline material with an average crystal size of about 70 nm, while the second (FIG. 4B) consists of nanocrystals with a size of about 5 nm.

All the main peaks in FIG. 4A correspond well to $Nd_2Fe_{14}B$ and $NdPrFe_{14}B$ (their peaks have almost identical positions), and the remaining peaks correspond to $Dy_2O_3$, which were only a few percent. According to the EDS results (Table 3), the two main phases in sample 1 had the same amount. In FIG. 4B, peaks of $Nd_2Fe_{14}B$ (or $NdPrFe_{14}B$), were observed, but they were relatively small. Compounds shown above the main peaks in FIG. 5B were found, given also in Table 3.

Thermodynamic Calculations.

Calculations of Gibbs energy were performed using a computer program and based on standard values for the pure substances [11]. The Gibbs energy (ΔG) in the temperature range 373-773 K is shown in Table 4 for chlorination reactions with chlorine gas.

TABLE 4

Gibbs energy (ΔG) calculated for high temperature treatment of used magnet.

| | | Temperature, K | | | |
|---|---|---|---|---|---|
| N | Reaction | 473 | 573 | 673 | 773 |
| | | ΔG, kJ/mole | | | |
| 1 | Fe (s) + 1.5 $Cl_2$ (g) => $FeCl_3$ (s) | −295.8 | −275.9 | −263.0 | −251.3 |
| 2 | Fe (s) + 1.5 $Cl_2$ (g) => $FeCl_3$ (g) | −242.3 | −240.5 | −238.6 | −236.6 |
| 3 | Nd + 1.5 $Cl_2$ (g) => $NdCl_3$ (s) | −923.4 | −899.4 | −875.8 | −852.7 |
| 4 | B (s) + 1.5 $Cl_2$ (g) => $BCl_3$ (g) | −379.1 | −374.1 | −369.0 | −364.0 |
| 5 | Pr (s) + 1.5 $Cl_2$ (g) => $PrCl_3$ (s) | −937.1 | −913.0 | −889.3 | −866.0 |
| 6 | Dy(s) + 1.5 $Cl_2$ (g) => $DyCl_3$ (s) | −863.3 | −836.3 | −809.6 | −783.2 |
| 7 | $Dy_2O_3$ (s) + 3 $Cl_2$ (g) = 2$DyCl_3$ (s) + 1.5 $O_2$ (g) | 394.9 | 372.1 | 349.7 | 327.8 |
| 8 | Ce (s) + 1.5 Cl2 (g) => $CeCl_3$ (s) | −934.5 | −910.4 | −886.7 | −863.5 |

s—solid,
g—gas.

Under sintering conditions, the Gibbs energy of the reactions (1-, 6, 8) was strongly negative within a wide temperature range, including the range of interest 573-673 K, with the most negative value being ΔG=−(800-900) kJ/mole for reactions (3 and 5). Thus, the highest probability of reactions (1)-(6, 8) can be expected immediately after injection of the chlorine gas. Dysprosium was present in magnets as an additive in the form of oxide $Dy_2O_3$ and did not react with chlorine (reaction 7 from Table 4).

Experimental Procedure

Figure 9:
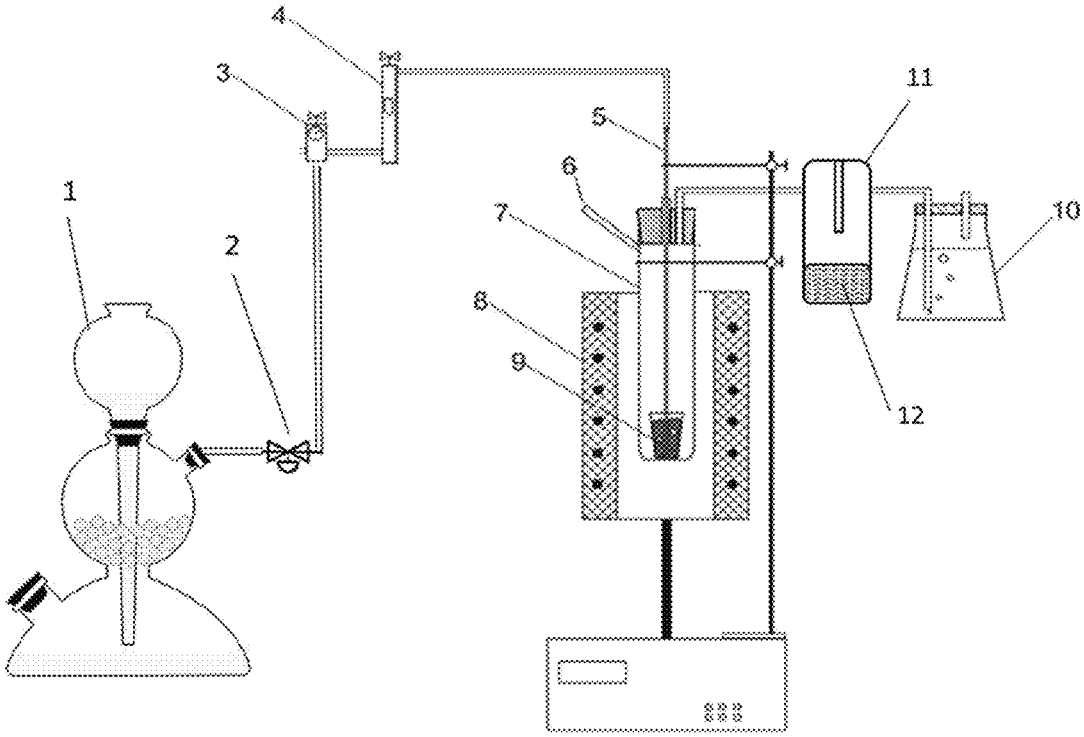
FIG. 9 shows the laboratory setup for chlorine treatment for extraction rare earth metals from permanent magnets.

Sintering of neodymium magnet with chlorine gas was carried out in a temperature-controlled laboratory furnace at 400° C.: sintering time was 2 hour. The laboratory setup is described in FIG. 9.

Pieces (30-40 mm) of the neodymium magnet (as they were, without demagnetization, crushing and milling) were placed in the furnace in a Pyrex glass crucible. Prior to heating, the quartz reactor was cleaned under 100 ml/min nitrogen flow, following which the furnace was heated to a given temperature, again under 100 ml/min nitrogen flow. Chlorine gas was fed into the reactor after the latter had reached the designated temperature. All elements (iron, neodymium, praseodymium, and boron) were chlorinated in accordance with reactions (1-6, 8) from Table 4. Dysprosium oxide $Dy_2O_3$ did not react with chlorine (reaction 7 from Table 4).

Chlorides of iron and boron were sublimated (Boiling point of the $FeCl_3$ is 316° C., boiling point of the $BCl_3$ is −107° C.) and rare earth metals chlorides remain in the residual clinker (Boiling point of the $NdCl_3$ is 1600° C., boiling point of the $PrCl_3$ is 1710° C.). Rare earth metals chlorides and $Dy_2O_3$ were formed of the solid powder clinker (Melting point of the $NdCl_3$ is 758° C., melting point of the $PrCl_3$ is 786° C., melting point of the $Dy_2O_3$ is 2408° C.). Air was added to the top part of the reactor for iron chloride oxidation in accordance with reaction (7).

$$2FeCl_3+1.5O_2=Fe_2O_3+3Cl_2 \quad (7)$$

Chlorine was obtained by reaction (7) and could have returned to the Pilot or industrial unit to the chlorination stage, therefore a circulation of chlorine gas can be achieved.

After cooling under nitrogen flow, the crucible was removed from the furnace and broken. The final product (solid $NdCl_3$—$PrCl_3$ clinker) was weighed and analyzed with XRD and EDS. Mixture of the iron chloride and iron oxide was collected from the top part of the reactor and analyzed with XRD and EDS.

Figure 10A:
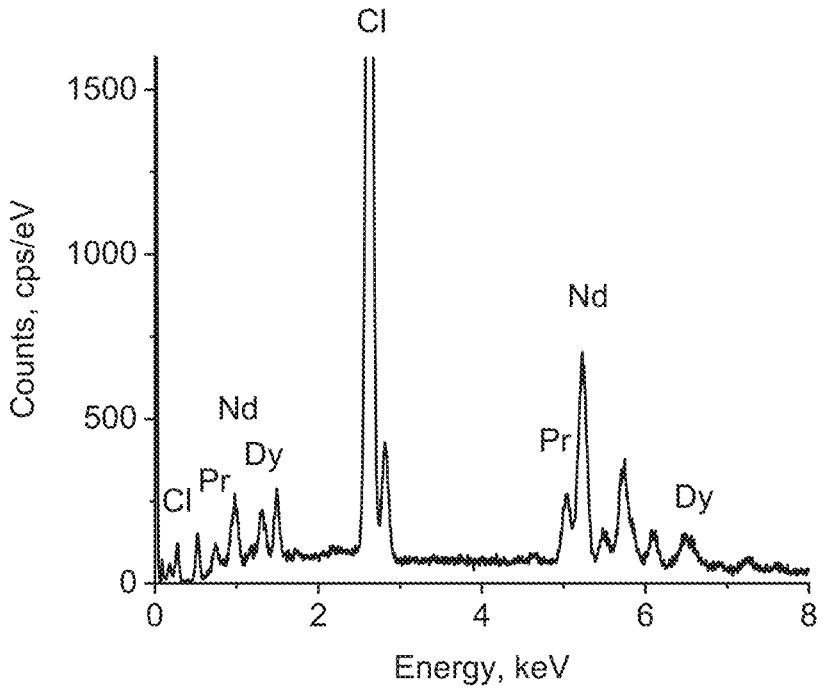
FIGS. 10A and 10B show characterization of the composition of the material after chlorine gas treatment by energy dispersive X-ray fluorescence spectroscopy (EDS, LEO Supra) of Sample 1 (FIG. 10A) and Sample 2 (FIG. 10B).
Figure 10B:
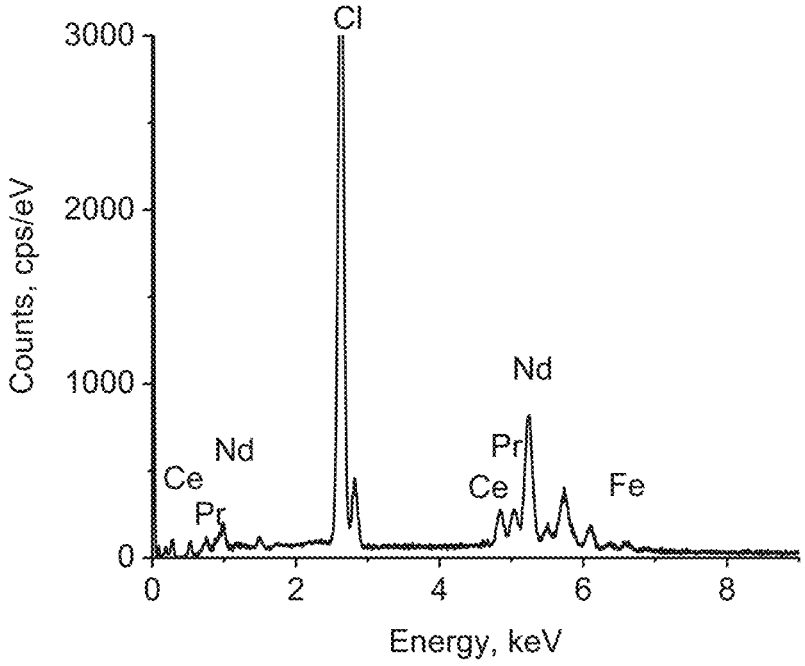

The composition of the material was characterized by energy dispersive X-ray fluorescence spectroscopy (EDS, LEO Supra) (FIGS. 10A-10B and Table 5).

TABLE 5

The composition of the neodymium clinker (mass (%).

| Sample | Iron | Neodymium | Praseodymium | Dysprosium |
|---|---|---|---|---|
| 1 | 0.4 | 56.3 | 26.3 | 9.1 |
| 2 | 0.4 | 59.0 | 32.2 | 1.5 |

The resulting rare earth metals chlorides can be easily processed by electrolysis of the molten salts for metallic rare earth metals production [12-13].

Figure 11A:
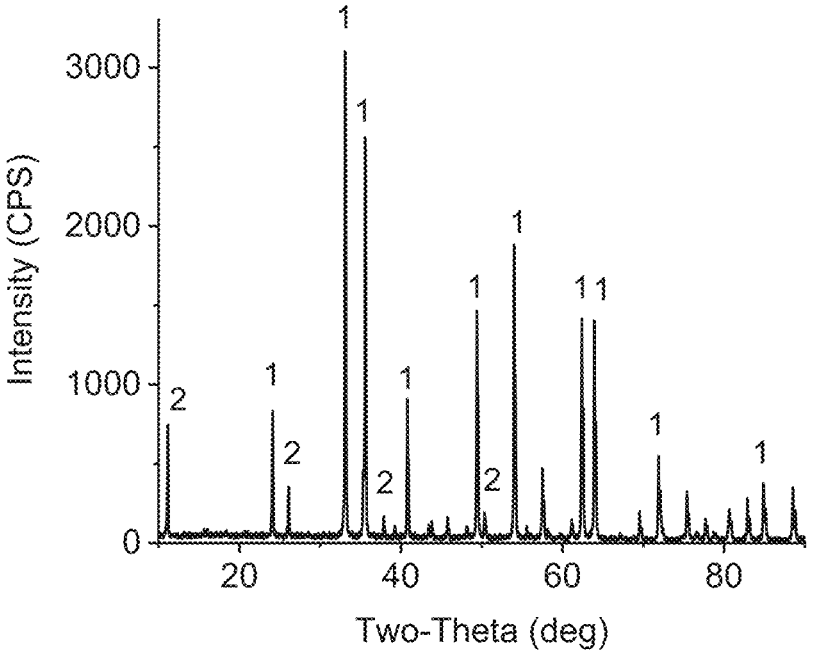
FIG. 11A shows powder X-ray diffraction (XRD) pattern of the sublimations from neodymium magnet samples following temperature treatment (400° C.) with chlorine gas. "1" refers to $Fe_2O_3$ and "2" refers to FeOCl.
Figure 11B:
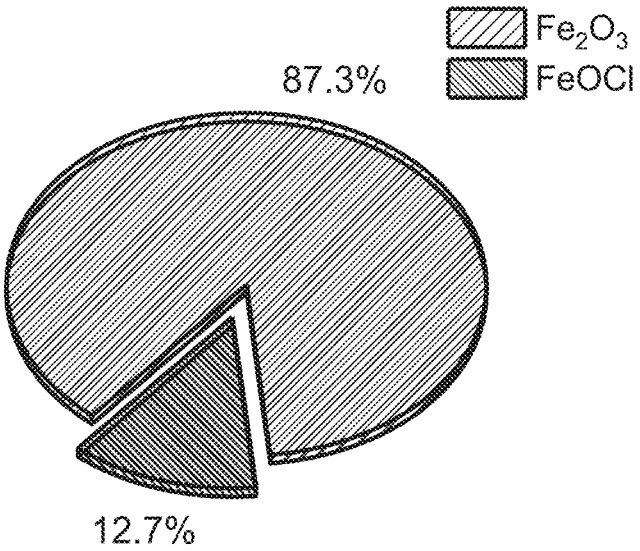
FIG. 11B shows Quantitative phase analysis of the sublimations as obtained from the XRD pattern in FIG. 11A.

Quantitative phase analysis of X-ray diffraction patterns of sublimations (FIG. 11A) showed that two crystalline iron-content phases (hematite $Fe_2O_3$ and iron (III) oxide chloride FeOCl) were obtained with hematite being dominant (FIG. 11B).

Example 4—Electrolytic Hydrogen Decrepitation of Nd Based Magnets

Materials

Fragments of end-of-life rare earth elements-Fe—B (REE-Fe—B) alloy magnets removed from computer hard disc drives The magnets had originally been coated with aluminum; however, prior to shipment to Israel, the surfaces were polished, and thereby, part of the surface had corrosion.

Methods

Structural Characterization

X-ray diffraction (XRD) of the as-received magnet fragments was performed on a TTRAX III theta-theta diffractometer while the patterns of the HD powder were measured on an Ultima III theta-theta diffractometer (both diffractometers are products of the Rigaku Corporation, Japan). Phase identification was accomplished using Jade_Pro (MDI, CAL.) software and the Inorganic Crystal Structure Database (ICSD). Cu $K_\alpha$ X-radiation, Bragg-Brentano protocol, diffracted beam monochromator and variable divergence slit widths constituted our standard operating procedure on both diffractometers. Element content of the magnet fragments and HD powders was characterized by energy dispersive (X-ray fluorescence) spectroscopy (EDS) on a LEO Supra scanning electron microscope (SEM). Mass % metal content was quantitated by inductively coupled plasma mass spectroscopy (ICP-MS, Agilent 7700s) following dissolution of the magnet or HD powder in aqua regia, 0.65 gr. of the as-received magnet fragments were dissolved in 100 ml aqua regia at room temperature with continuous stirring during 24 hours. This solution was diluted to 1000 ml with deionized water to prepare stock solution. 2 ml of stock solution were subsequently diluted to 100 ml with deionized water. 0.86 gr of hydrogen decrepitated powder (following electrolysis, filtration and drying in air at 353K) were dissolved in 100 ml aqua regia with continuous stirring at room temperature for 24 hours. The solution was then diluted to 200 ml with deionized water. Two powder samples were measured. For sample #1, 2 ml of the stock solution were diluted to 1000 ml, and for sample #2, 5 ml of the stock solution were diluted to 1000 ml, both with deionized water.

Electrolysis.

Details of the laboratory-scale, electrolysis cell are shown in FIG. 6. A glass vessel containing 700 ml of 1M/liter KOH solution served as the electrolytic bath. A homemade titanium metal cathode, dimensions [3.5×3.5] $cm^2$, and a nickel, plate-shaped anode, dimensions [4.0×4.0] $cm^2$ served as the electrodes. An 18 mesh titanium grid was in electrical contact with the cathode. Electrical potential 4.7 V and current, 13-15 A, were provided by a Kepco power supply KLP-20-120-1200. The cathode current density was 0.8-0.9 $A/cm^2$, where the total area included the Ti grid. 30-40 mm fragments, total weight 300-500 gr, of as-received Nd-magnets (without demagnetization, crushing or milling) were placed on the titanium grid. Two hours of electrolysis at room temperature produced a decrepitated powder with grains that were sufficiently small to readily pass through the 1 mm diameter holes in the Ti grid and collect on the bottom surface of the glass container. Powder was removed from the electrolyte solution by filtration and then dried at 353K in air. Subsequent mesh sieving provided an upper limit on grain size.

Magnetic Properties

A SQUID magnetometer (MPMS3, L.O.T.—Quantum Design, Inc.) was used in the vibrating (VSM) mode with peak amplitude 2 mm, frequency 13 Hz and averaging time 10 s. The magnetic moment (M, [$10^{-3}$ $Am^2$]) of each sample was measured at ambient temperature (300 K) with field strengths $|\mu_o H=6$ T. The temperature dependence of the magnetic moment of the samples was measured at $\mu_o H=6$ T and fit to the modified Bloch law using the Levenberg-Marquardt algorithm for non-linear curve fitting in Origin (OriginLab MA). One fragment of the as-received magnet, and a sample of the fine, electrolytically decrepitated magnet, powder were measured. The mass of the thin, elongated, plate-shaped magnet fragment was 31.0 mg, with approximate dimensions [5×2.8×0.3] $mm^3$. To justify neglecting the demagnetizing factor, the sample was oriented in the magnetometer such that the direction of the magnetic field was parallel to the flat sample surface. Duplicate measurements were made first in a standard brass sample holder and then in a quartz holder. The mass of the fine grain HD powder sample was 10.1 mg. The demagnetizing factor was estimated to be D=0.23, consistent with the size and shape of the powder sample [14] placed in the standard brass holder.

Results and Discussion

Structural Characterization of the Nd-Magnet Fragments Prior to Electrolysis.

The structural characteristics of the as-received, hard disc drive, Nd-magnet fragments used here for the electrolytic hydrogen decrepitation experiments have recently been published by our group. The as-received Nd-magnet fragments appear irregularly shaped, 20-30 mm dimensions and with a partially corroded surface. Whole pattern fitting of the XRD profile to ICSD pattern #48143 measured on a relatively undamaged surface region, gave R-factor of not better than ~20%, due predominantly to the difficulty in fitting such a highly textured alloy. The $CuK_\alpha$ radiation was only able to probe ~10 micron thick layer at the magnet surface, due to the strong absorption of the RE (rare earth) metals and iron at 8 KeV. A SEM image of the surface and an EDS spectrum are shown in FIGS. 5A-5D. Here again, only a thin layer (1-2 μm) at the fragment surface is probed. The magnet contained Dy (Dysprosium) as an additive, in addition to Pr (Praseodymium). ICP-MS quantitative elemental analysis (mass %) of the as-received magnet, solubilized as described in Section 2, gives: Nd, 23.5; Pr, 7.8; Dy, 3.7: Ce, 0.01; Fe, 61.7; Al, 0.6. Boron was not checked.

Thermodynamic Calculations.

As a guide for understanding the reaction thermodynamics of each of the metal alloy components with hydrogen, the Gibbs energies for reactions with atomic hydrogen or with hydrogen gas in the temperature range 273-473 K were calculated. Calculations were performed using a computer program developed by some of the authors and based on standard values for the pure substances [11]. The Gibbs energy (ΔG) in the temperature range 273-473 K is shown in Table 6 for reactions with hydrogen: Group 1—reactions with atomic hydrogen and Group 2—reactions with hydrogen gas.

TABLE 6

Gibbs energy (ΔG) calculated for electrolytic reactions of $Nd_2Fe_{14}B$ sintered alloy magnet fragments with either atomic hydrogen (Group 1) or (Group 2) hydrogen gas in the temperature region of interest.

| | | ΔG (kJ/mole) | | | | |
|---|---|---|---|---|---|---|
| Reaction # | Reaction | 273 K | 323 K | 373 K | 423 K | 473 K |
| | Group 1 (reaction with atomic hydrogen) | | | | | |
| 1 | Nd (s) + 2H = $NdH_2$ (s) | −572.1 | −560.0 | −547.7 | −535.3 | −522.6 |
| 2 | Pr (s) + 2H = $PrH_2$ (s) | −568.6 | −556.3 | −543.7 | −531.0 | −518.1 |
| 3 | Dy (s) + 2H = $DyH_2$ (s) | −602.3 | −590.3 | −578.1 | −565.6 | −553.0 |
| 4 | Fe (s) + H = FeH (g) | 212.3 | 208.9 | 205.6 | 202.3 | 199.2 |
| 5 | B (s) + 3H = $0.5B_2H_6$ (g) | −571.8 | −560.1 | −548.1 | −535.8 | −523.2 |
| 6 | Al (s) + 3H = $AlH_3$ (s) | −571.8 | −554.7 | −537.3 | −519.5 | −501.6 |
| | Group 2 (reaction with hydrogen gas) | | | | | |
| 7 | Nd (s) + $H_2$ (g) = $NdH_2$ (s) | −163.1 | −155.9 | −148.7 | −141.3 | −133.9 |
| 8 | Pr (s) + $H_2$ (g) = $PrH_2$ (s) | −159.6 | −152.2 | −144.7 | −137.1 | −129.4 |
| 9 | Dy (s) + $H_2$ (g) = $DyH_2$ (s) | −193.3 | −186.2 | −179.0 | −171.7 | −164.2 |
| 10 | Fe (s) + $0.5H_2$ (g) = FeH (g) | 416.8 | 410.9 | 405.1 | 399.3 | 393.5 |
| 11 | B (s) + $1.5H_2$ (g) = $0.5B_2H_6$ (g) | 41.7 | 46.0 | 50.5 | 55.1 | 59.9 |
| 12 | Al (s) + $1.5H_2$ (g) = $0.5AlH_3$ (s) | 41.7 | 51.4 | 61.3 | 71.4 | 81.5 |

Under the conditions of our experiments, the Gibbs energy of reactions (1, 2) in Group 1 for rare earth metals was strongly negative (−520 to −570 kJ/mole). Calculations predict that the reactions of Nd and Pr with atomic hydrogen can result in the formation of Nd and Pr hydrides within a wide temperature range, including the range of interest. Metallic dysprosium may react with atomic hydrogen, producing $DyH_2$ (reaction 3). Group 2 includes reactions between magnet components and hydrogen gas. The likelihood of reactions (7-9) was ensured over the entire temperature range of interest as well. However, the values of Gibbs energy for reactions (7,8) were much less negative than those for reactions (1, 2). Iron participates only marginally in reactions with both atomic hydrogen and hydrogen gas under our experimental conditions (reactions 4, 10). Boron is highly reactive with atomic H but not with hydrogen gas. The resulting $B_2H_6$ gas is moderately toxic upon inhalation, but it is readily converted to boric acid by hydrolysis. The damaged aluminum coating remaining on the magnet fragments was not predicted to react with hydrogen gas but should convert to Al hydride via interaction with atomic hydrogen.

Table 7 includes hydrolysis reactions of the neodymium, praseodymium, and dysprosium hydrides in water. Under the experimental conditions, the Gibbs energy of reactions (1-6) for rare earth metal hydrides was strongly negative (approx. −340 to −500 kJ/mole) Thermodynamic calculations therefore predicted that hydrolysis reactions of neodymium, praseodymium, and dysprosium hydrides may result in the formation of Nd, Pr, and Dy hydroxides or oxides within a wide temperature range, including the range of interest 273-473 K. Similarly, hydrolysis may result in the oxidation of iron to hematite as well as other iron oxides (Table 7.)

TABLE 7

Gibbs energy (ΔG) calculated within the temperature range of interest for reactions of the solid products with water, following electrolytic decrepitation of $Nd_2Fe_{14}B$ sintered alloy magnet fragments

| | | ΔG (kJ/mole) | | | | |
|---|---|---|---|---|---|---|
| # | Reaction | 273 K | 323 K | 373 K | 423 K | 473 K |
| 1 | $NdH_2$ (s) + $3H_2O$ (l) = $Nd(OH)_3$ (s) + $2.5H_2$ (g) | −496.6 | −506.0 | −514.8 | −523.2 | −531.1 |
| 2 | $PrH_2$ (s) + $3H_2O$ (l) = $Pr(OH)_3$ (s) + $2.5H_2$ (g) | −413.8 | −423.4 | −432.4 | −440.8 | −448.8 |
| 3 | $DyH_2$ (s) + $3H_2O$ (l) = $Dy(OH)_3$ (s) + $2.5H_2$ (g) | −388.8 | −397.9 | −405.5 | −411.9 | −417.1 |
| 4 | $NdH_2$ (s) + $1.5H_2O$ (l) = $0.5Nd_2O_3$ (s) + $2.5H_2$ (g) | −339.4 | −351.5 | −363.4 | −375.2 | −386.7 |
| 5 | $PrH_2$ (s) + $1.5H_2O$ (l) = $0.5Pr_2O_3$ (s) + $2.5H_2$ (g) | −342.7 | −354.9 | −366.9 | 378.8 | 390.5 |
| 6 | $DyH_2$ (s) + $1.5H_2O$ (l) = $0.5Dy_2O_3$ (s) + $2.5H_2$ (G) | −334.3 | −345.9 | −357.4 | −368.7 | −380.0 |

TABLE 7-continued

Gibbs energy (ΔG) calculated within the temperature range of interest for reactions of the solid products with water, following electrolytic decrepitation of $Nd_2Fe_{14}B$ sintered alloy magnet fragments

| # | Reaction | ΔG (kJ/mole) 273 K | 323 K | 373 K | 423 K | 473 K |
|---|---|---|---|---|---|---|
| 7 | Fe (s) + $3H_2O$ (l) = $Fe(OH)_3$ (s) + $1.5H_2$ (g) | 4.2 | 0.9 | −1.6 | −3.6 | −5.2 |
| 8 | Fe (s) + $1.5H_2O$ (l) = $0.5Fe_2O_3$ (s) + $1.5H_2$ (g) | −12.1 | −17.5 | −22.5 | −27,3 | −31.9 |

s—solid, l—liquid, g—gas.

Electrolytic Hydrogen Decrepitation.

Figure 12A:
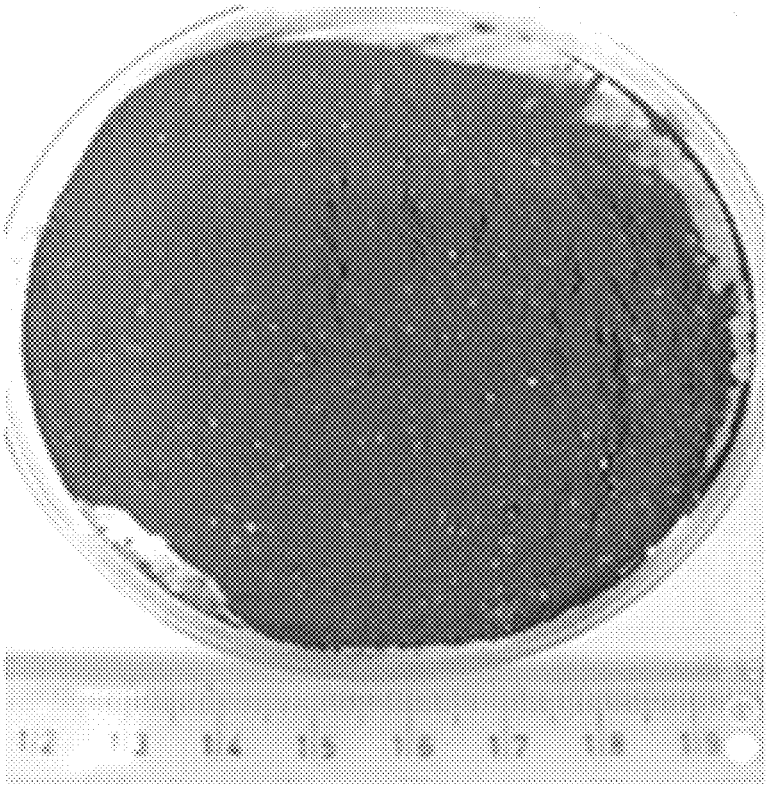
FIGS. 12A-12C present fine grain powder obtained following electrolytic hydrogen decrepitation of cm-size, Nd-magnet fragments during 2 hrs under ambient conditions.
Figure 12B:
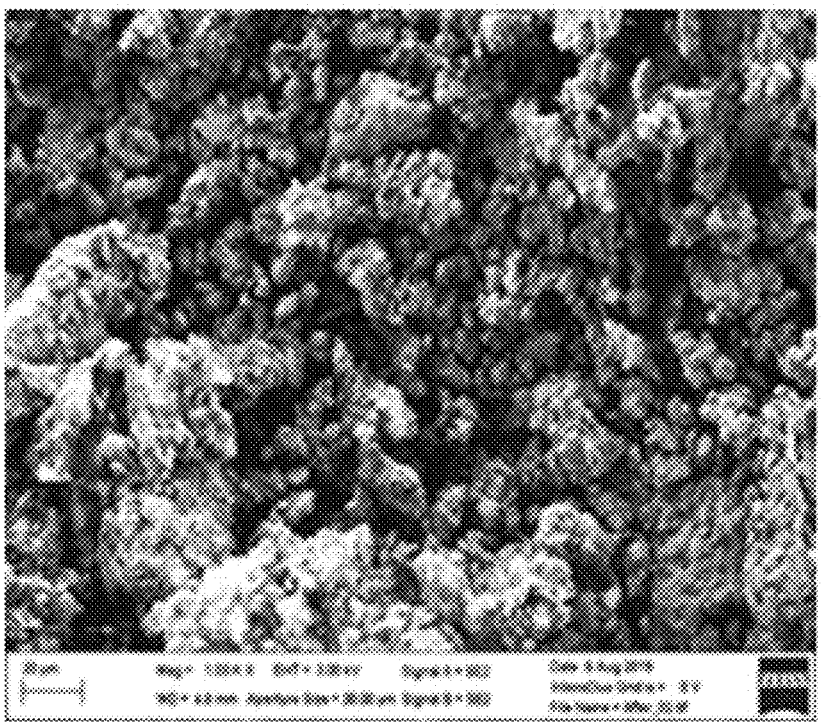

As noted above, the calculated Gibbs energy of reactions of individual REE (rare earth elements) with atomic hydrogen (Table 6) is strongly negative, thereby predictive of rapid chemical decrepitation of the two-phase Nd-magnet within the temperature range of interest. These reactions take place immediately following initiation of atomic hydrogen release at the cathode during electrolysis. Following 2 hr electrolysis at room temperature as described in the Methods Section above, complete magnet decrepitation was observed, producing a powder with particle size of <200 mesh. The powder was filtered from the KOH electrolyte and dried at 353K in air. Subsequent sieving through various sized mesh gave an upper bound of 44 μm for the particle size of the HD powders (FIGS. 12A, 12B). The HD powders were also characterized for elemental composition and crystal structure.

Figure 12C:
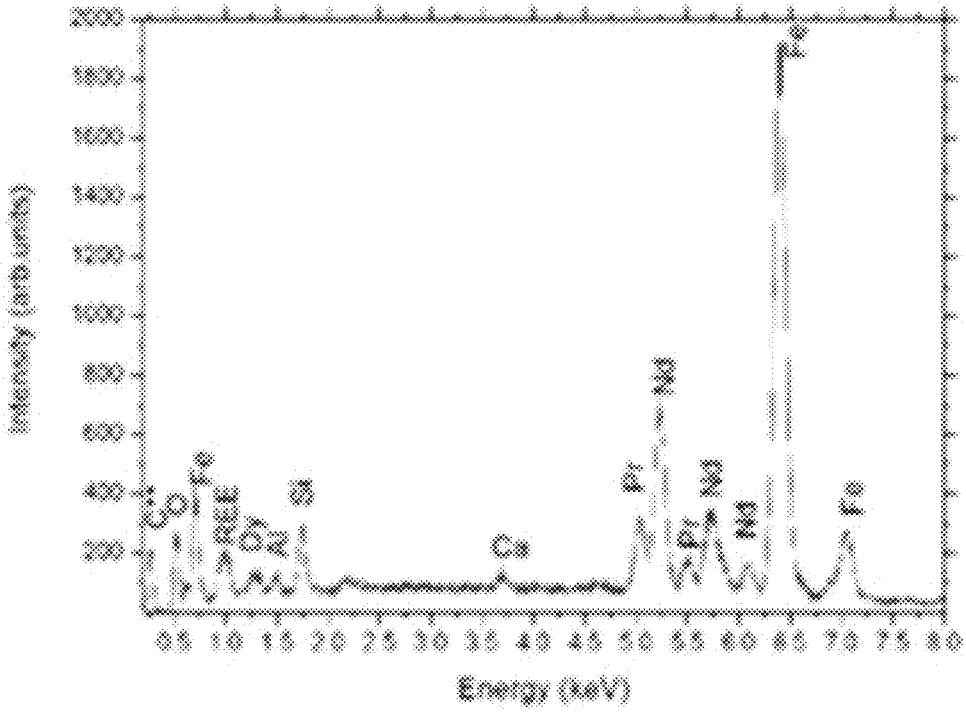

Except for the additional X-ray fluorescence (XRF) peaks identified as being due to Si and Ca, the EDS spectrum in FIG. 12C is very similar to the spectrum of the as-received magnet fragments (FIGS. 5A-5D). It is possible that Si and Ca were etched from the electrolysis cell by the alkaline electrolyte. ICP-MS quantitative analysis (mass %, average of the two HD samples) gives: Nd—15.99; Pr—5.98; Dy—3.23; Ce—0.02; Fe—49.87; B—0.95; Si—0.91; Ca—0.03.

X-Ray Diffraction Phase Analysis of Fine Grain HD Particles.

Phase identification of X-ray diffraction (XRD) peaks from the fine grain HD particles (FIG. 13) associates the majority with the magnet alloy hydride $Nd_2Fe_{14}BH_{1.86}$ (ICSD #80973). Nd-magnet hydride has the same tetragonal crystal symmetry as the original metal alloy with only a moderately expanded unit cell volume.[15] The SEM image (FIG. 12B) showed that the powder contains a broad mixture of globular shapes and sizes. XRD profile fitting with Jade_Pro reveals that while the as-received magnet is strongly anisotropic (textured), the Nd-magnet hydride powder is essentially crystallographically isotropic. (* ICSD refers to Inorganic Crystal Structure Database, world's largest database for completely identified inorganic crystal structures)

The increase in unit cell dimensions reveals that during electrolysis under ambient conditions, atomic H is able to be absorbed into the matrix following absorption into the Nd-rich grain boundary phase. (Table 8).

TABLE 8

(S-1)
Hydrogen-induced increase in the volume of the tetragonal unit cell of $Nd_2Fe_{14}BH_x$ as af unction of hydrogen content, [15]. The space group ($P4_2/m$ nm, Z = 4) is unchanged.

| | a(Å) | c (Å) | V (Å$^3$) | DV/V %) |
|---|---|---|---|---|
| $Nd_2Fe_{14}B$ | 8.805 | 12.206 | 946 | — |
| $Nd_2Fe_{14}BH$ | 8.841 | 12.242 | 957 | 1.2 |
| $Nd_2Fe_{14}H_2$ | 8.869 | 12.294 | 967 | 2.2 |
| $Nd_2Fe_{14}BH_3$ | 8.806 | 12.327 | 978 | 3.4 |
| $Nd_2Fe_{14}BH_4$ | 8.817 | 12.344 | 982 | 3.8 |
| $Nd_2Fe_{14}BH_{4.5}$ | 8.826 | 12.366 | 985 | 4.1 |

Figure 13:
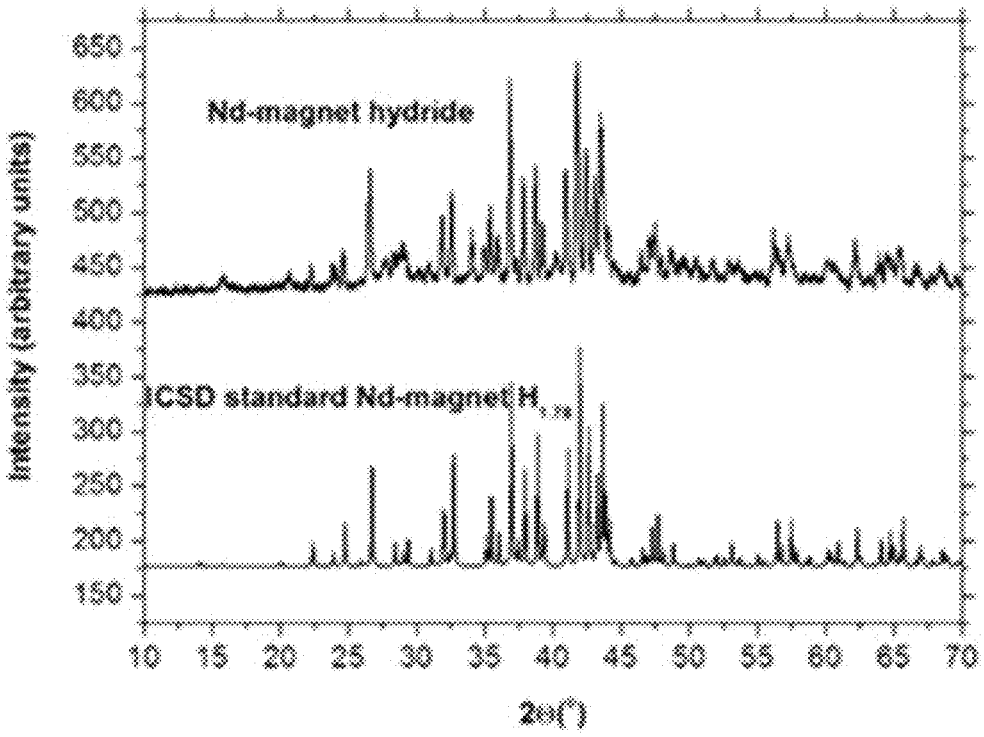
FIG. 13 presents Powder X-ray diffraction (XRD) pattern of the fine grain, decrepitated magnet powder obtained following 2 hr of room temperature electrolysis in 1M KOH solution is compared with that of the $Nd_2Fe_{14}BH_{1.86}$ standard powder pattern (ICSD #80973). The XRD pattern of the HD powder was unchanged after 4 months storage in air under ambient conditions.

By comparing the lattice parameters determined from the XRD pattern shown in FIG. 13 with those tabulated in Table 8, it can be seen that electrolytic decrepitation under ambient conditions during two hours introduces approx. two H atoms per formula unit into the crystalline matrix.

It is the absorption of H into this electron deficient, intergranular boundary phase that produces the decrepitation of the sintered magnetic alloy.[20] Even in the alloy matrix, H tends to be positioned near Nd atoms, rather than near the Fe or B atoms. [15] X-ray diffraction peaks which cannot be associated with the magnet alloy hydride, have been tentatively identified as minor phases of Nd-oxide (Ia-3) (ICSD #191535) and Nd-tri hydroxide (ICSD #398), as well as Pr-oxide (ICSD #75481) and $NdFe_2$ alloy (ICSD #103548). One or more of the various iron oxide phases, including hematite may also be present. This multiplicity of possible minor phases makes quantitative analysis of the electrolytic HD powder XRD pattern very challenging. (* ICSD refers to Inorganic Crystal Structure Database, world's largest database for completely identified inorganic crystal structures).

Magnetic Properties of Electrolytically Decrepitated E-o-L NdFeB Magnets

Figure 14A:
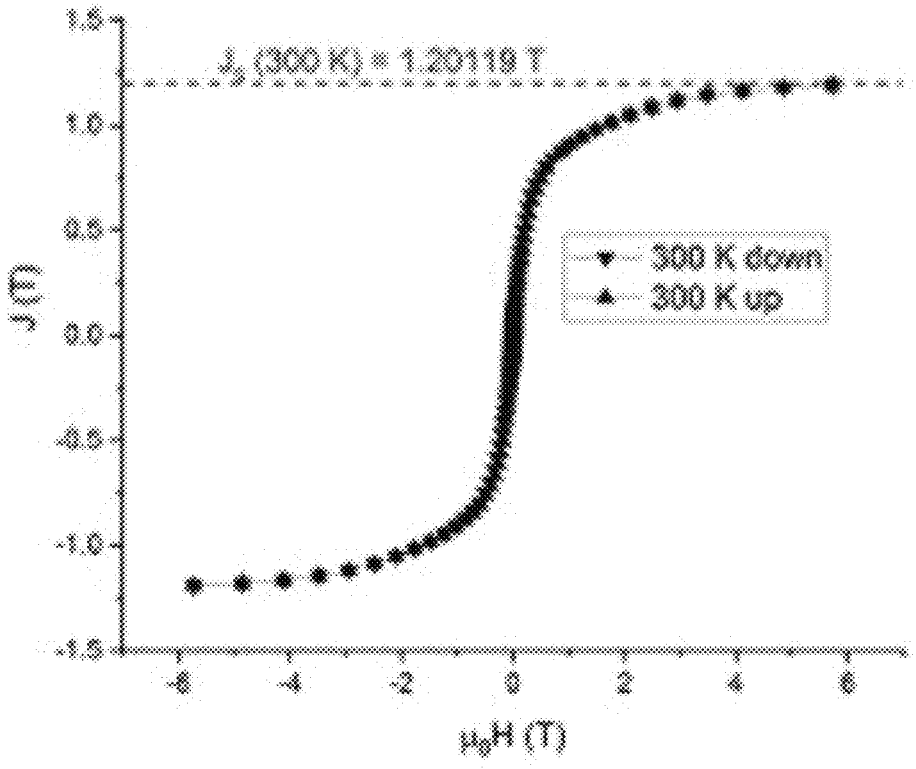
FIGS. 14A-14C present SQUID magnetometer VSM measurement of the magnetic properties of the HD powder at 300K as a function of applied magnetic field, $\mu_0H$ [T]
Figure 14B:
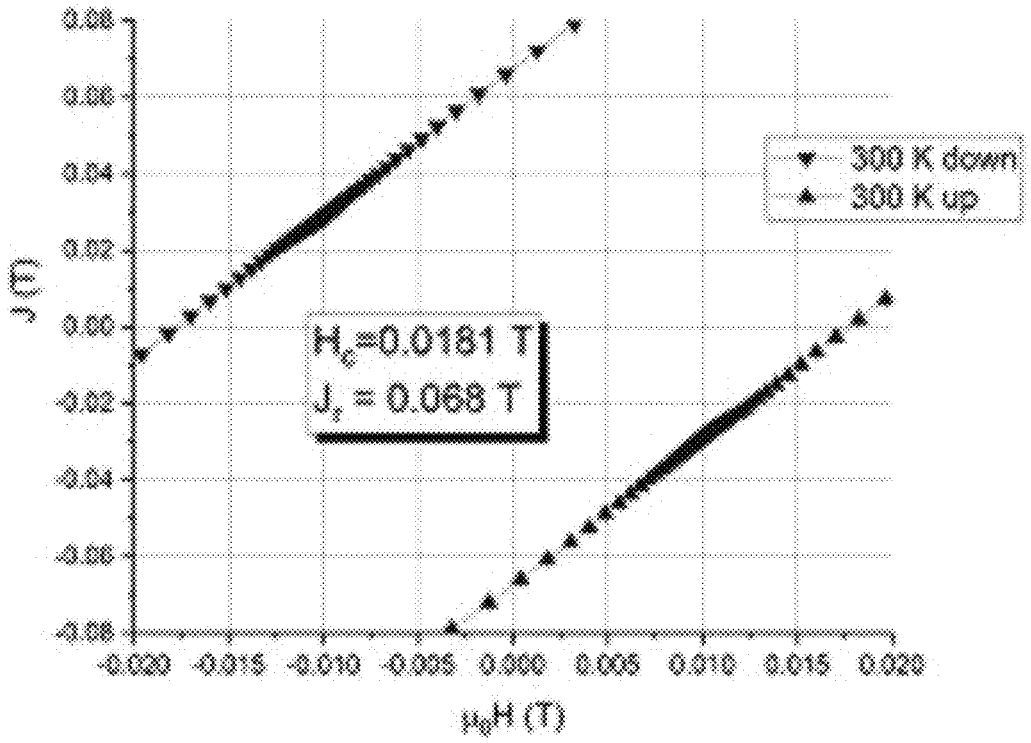
Figure 14C:
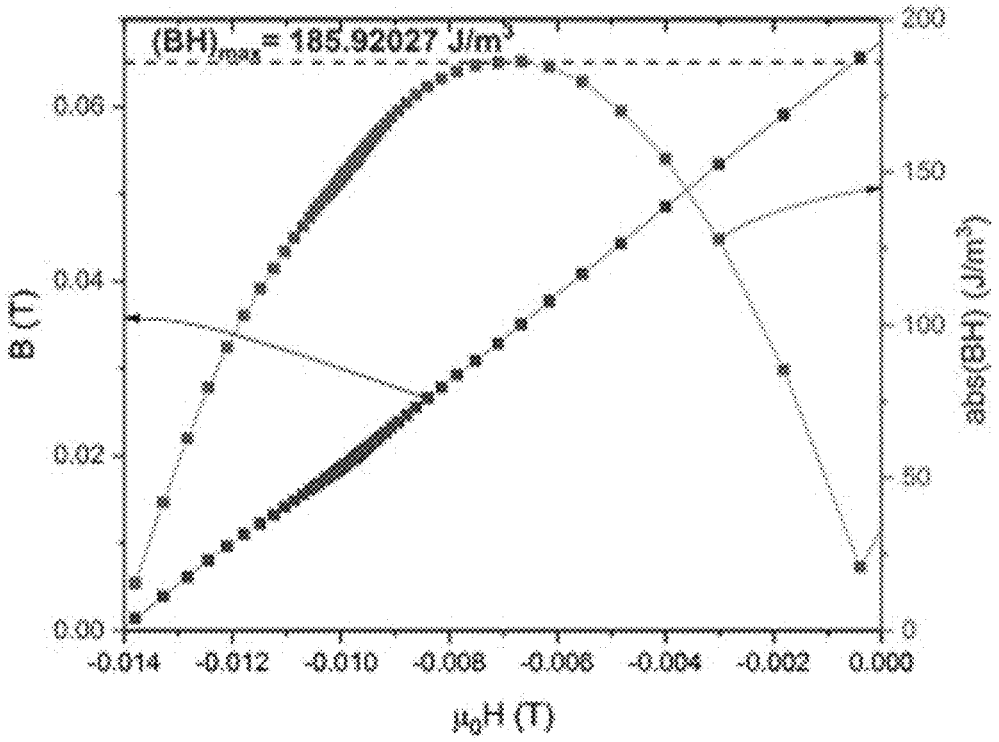

The magnetic properties of the electrolytic HD powder were characterized as described in the Method Section above. Results are summarized in Table 9 (SQUID magnetometer data are presented in FIGS. 14A-14C, and in FIG. 15) and compared to those obtained from the untreated Nd-magnet fragment. As expected for small grain HD powders that have not been degassed at elevated temperatures, only weak remanent magnetic polarization $J_{rem}$ and coercive field $H_c$ (FIGS. 14A, 14B) are detected in SQUID magnetometer measurements.[16] Accordingly, the magnetic energy density of the HD powder (FIG. 14C) is $10^3$-fold lower than that of the as-received E-o-L Nd-magnet.

TABLE 9

Comparison of the magnetic properties of the thin plate sample of an as-received, sintered Nd-magnet fragment and the fine grain, electrolytically decrepitated powder as measured in the SQUID magnetometer. Definition of terms: $J_{sat}$—saturation magnetic polarization; $M_{sat}$—saturation magnetization; $H_c$—coercive magnetic field; $J_{rem}$—remanent magnetic polarization; $(BH)_{max}$ = maximum magnetic energy density.

| | Fine grain, electrolytically decrepitated magnet powder (brass holder) | Thin plate fragment of as-received magnet (brass/quartz holder) |
|---|---|---|
| $J_{sat}$ (300 K, 6 T), [Tesla] | 1.20 | 1.16-1.15 |
| $M_{sat}$ (300 K, 6 T), A m$^2$ kg$^{-1}$ | 126 | 123-122 |

TABLE 9-continued

Comparison of the magnetic properties of the thin plate sample of an as-received, sintered Nd-magnet fragment and the fine grain, electrolytically decrepitated powder as measured in the SQUID magnetometer. Definition of terms: $J_{sat}$—saturation magnetic polarization; $M_{sat}$—saturation magnetization; $H_c$—coercive magnetic field; $J_{rem}$—remanent magnetic polarization; $(BH)_{max}$ = maximum magnetic energy density.

| | Fine grain, electrolytically decrepitated magnet powder (brass holder) | Thin plate fragment of as-received magnet (brass/quartz holder) |
|---|---|---|
| $\mu_0 H_c$(300 K), [Tesla] | 0.0181 | 2.54-2.54 |
| $J_{rem}$ (300 K), [Tesla] | 0.068 | 1.08-1.07 |
| $(BH)_{max}$, [Joule/m$^3$] (300 K) | 186 | 208000-193000 |
| $T_c$, [K]** | 936 | 1061-1048 |
| $\alpha$** | 2.35 | 1.67-1.68 |

Figure 15:
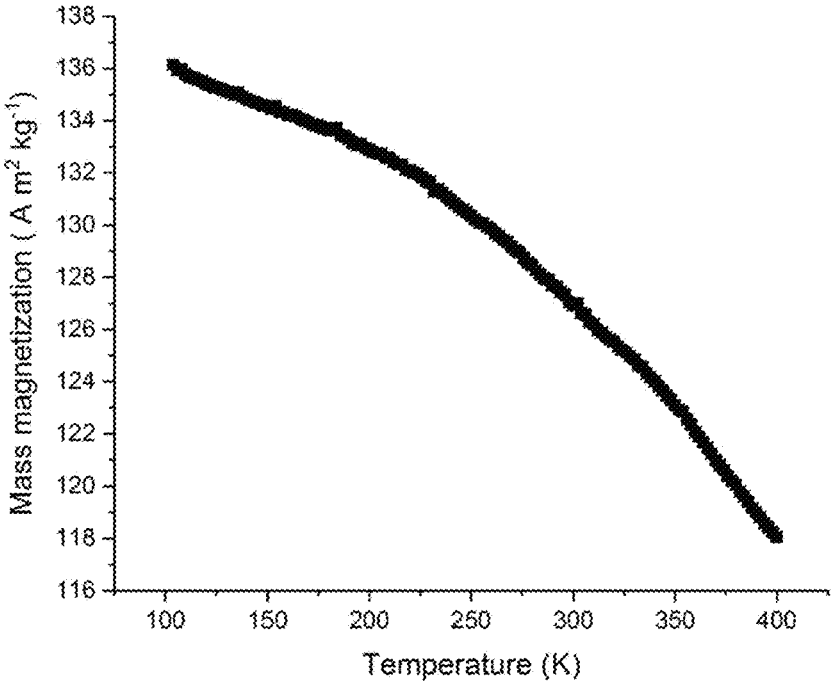
FIG. 15 presents temperature dependence of the saturation magnetization of the $Nd_2Fe_{14}BH_x$ fine grain powder produced via electrolytic hydrogen decrepitation. Temperature dependence of the HD powder saturation magnetization at constant external field 6 Tesla. The demagnetizing correction [14], (estimated as being very small) was not applied. Fitting to the modified Bloch law in the form: $M(T)=M(0)(1-(T/T_c)^{\alpha})$ was successfully performed, resulting in effective values of the parameters $M(0)=136.5\ Am^2 kg^{-1}$, $T_c=936$ K and $\alpha=2.35$ (R=0.99959).

**By fitting the measured magnetization as a function of temperature (FIG. 15 to the modified Bloch equation M(T) = M(0)? (1-(T/Tc)$^{\alpha}$, effective values are obtained for $T_c$ -Curie temperature, M(0), and the constant a. For strong ferromagnets at low temperature, $\alpha$≈3/2.

Oxidation of HD Powder

High levels of oxidation in $Nd_2Fe_{14}B$ alloy waste (3000-5000 ppm oxygen) constitute a serious impediment to large-scale recovery and recycling of the valuable rare earth metals. Even pristine NdFeB alloy may contain 300-400 ppm oxygen, with a majority of the oxidation reactions occurring within the Nd-rich grain boundaries. [17] Both confocal microscopy and Raman spectroscopy have been used to locate, measure and identify the growth of surface reaction products at room temperature immediately following exposure to air. [17] These measurements demonstrated that significant growth of $Nd_2O_3$ occurs at the triple junctions of the Nd-rich grain boundaries. It was furthermore found that oxidized triple junctions do not react with hydrogen to form $NdH_2$, leading to poor redistribution of the Nd-rich phase during subsequent resintering. The grain boundary phase no longer melts uniformly due to the very high melting temperature of the RE (rare earth) metal oxides and therefore full mass density cannot be achieved in the recycled magnets. Dispersed $Nd_2O_3$ compounds reduce the coercive force of $Nd_2Fe_{14}B$ alloys.

HD powders, with a large surface to volume ratio, oxidize rapidly upon exposure to air.[18] Very low magnetic coercivity at 300K, such as we report (Table 9), has also been ascribed to the presence of metallic α-Fe at grain boundaries. This soft magnetic phase is formed as a result of local disproportionation due to the exothermic reaction associated with the formation of neodymium hydride.[16] Upon additional processing of the powder under ambient conditions, the oxygen content will only increase. Later work [19] has shown that deterioration in sinterability, and hence in the magnetic properties, can be overcome, at least partially, by blending additional Nd in the form of Nd hydride into the HD powder.

Conclusions

Electrolytic hydrogen decrepitation can be an effective procedure for safely and economically pulverizing cm-size, sintered $Nd_2Fe_{14}B$ alloy magnet fragments to fine powder (grain size <325 mesh, i.e., <44 μm) under ambient conditions, with 1 M KOH as the aqueous electrolyte of choice. This process eliminates the need for high temperature equipment or for pure hydrogen atmosphere at high pressure. The fine grain NdFeB hydride powder may be processed further to form new magnetic materials or to facilitate separation of the valuable rare earth metals from the iron-containing components of the magnet.

LIST OF REFERENCES CITED

1. Asabe, K.; Saguchi, A.; Takahashi, W.; Suzuki, R. O.; Ono, K. Recycling of rare earth magnet scraps: Part I carbon removal by high temperature oxidation. Materials Transactions. 2001, 42, 2487-2491.
2. Saguchi, A.; Asabe, K.; Takahashi, W., Suzuki, R. O., Ono, K. Recycling of rare earth magnet scraps Part III carbon removal from Nd magnet grinding sludge under vacuum heating. Materials Transactions, 2002, 43, 256-260.
3. Sherdan, R. S.; Sillitoe, R.; Zakotnik, M.; Harris, I. R.; Williams, A. J. Anisotropic powder from sintered NdFeB magnets by HDDR processing route. Journal of Magnetism and Magnetic Materials, 2012, 324, 63-67.
4. Sato, N.; Wei, Y.; Nanjo, M.; Masanori, T. Recovery of samarium and neodymium from rare earth magnet scraps by fractional crystallization method. Metallurgical Review of MMIJ 1998, 15, 1-13.
5. Itakura, T.; Sasai, R.; Itoh, H. Resource recovery from Nd—Fe—B sintered magnet by hydrothermal treatment. Journal of Alloys and Compounds. 2006, 408-412, 1382-1385.
6. Masahiro Itoh, koji Muira, Ken-ichi Machida. Novel rare earth recovery process on Nd—Fe—B magnet scrap by selective chlorination using NH4Cl. Journal of Alloys and Compounds, 2009, 477, 484-487.
7. Tetsuya Uda. Recovery of Rare Earths from Magnet Sludge by FeCl2. Materials Transactions, 2002, 43, 1, 55-62.
8. Sakae Shirayama, Tory H. Okabe. Selective Extraction and Recovery of Nd and Dy from Nd—Fe—B Magnet Scrap by Utilizing Molten MgCl2. Metallurgical and Materials Transactions B. 2018, 49B, 1067-1077.
9. Yuuki Mochizuki, Naoto Tsubouchi, Katsuyasu Sugawara. Selective Recovery of Rare Earth Elements from Dy containing NdFeB Magnets by Chlorination. ACS Sustainable Chemistry & Engineering. 2013, 1, 655-662.
10. Baibekov M. K., Popov V. D., Cheprakov I. M. TiCl4 production. Moscow, Metallurgia, 1987, 128.
11. E. T. Turkdogan, Physical Chemistry of High Temperature Technology, Academic Press, 1980. New York, London.
12. Y. Kamimoto, T. Itoh, G. Yoshimura, K. Kuroda, T. Hagio, R. Ichino. Electrodeposition of rare-earth elements from neodymium magnets using molten salt electrolysis. Journal of Material Cycles and Waste Management (2018) 20:1918-1922.
13. H. Vogel, B. Friedrich. Development and Research Trends of the Neodymium Electrolysis—A Literature Review. European Metallurgical Conference, Dusseldorf. Proceedings of EMC 2015. 1-13.
14. Osborn J A (1945) Demagnetizing Factors of the General Ellipsoid. Phys. Rev. 67(11-12):351-357.
15. Isnard O, Yelon W B, Miraglia S, and Fruchart J D (1995) Neutron-diffraction study of the insertion scheme of hydrogen in $Nd_2Fe_{14}B$. J App Phys 78(3): 1892-1898.
16. Zakotnik M, Harris I R, Williams A J (2008) Possible methods of recycling NdFeB-type sintered magnets using the HD/degassing process. Journal of Alloys and Compounds 450:525-531.

17. Meakin J P, Speight J D, Sheridan R S, Bradshaw A, Harris I R, Williams A J, Walton A (2016) 3-D laser confocal microscopy study of the oxidation of NdFeB magnets in atmospheric conditions. Appl Surf Sci 378: 540-544.

18. Onal M A, Jönsson C, Zhou W, Van Gerven T, Guo M, Walton A Blanpain B (2017) Comparative oxidation behavior of Nd—Fe—B magnets for potential recycling methods: Effect of hydrogenation pre-treatment and magnet composition. Journal of Alloys and Compounds 728: 727-738.

19. Zakotnik M, Harris I R, Williams A J (2009) Multiple recycling of NdFeB-type sintered magnets. Journal of Alloys and Compounds 469:314-321.

20. Eliaz N, Eliezer D, Olson D L, (2000), Hydrogen-assisted processing of materials. Materials Science and Engineering A289: 41-53.

21. Harris I R, McGuiness P J (1991) Hydrogen: its use in the processing of NdFeB-type magnets. Journal of the Less Common Metals 172-174:1273-1284.

22. Walton A, Yi H, Rowson N A, Speight J D, Mann V S J, Sheridan R S, Bradshaw A, Harris I R, Williams A J (2015) The use of hydrogen to separate and recycle neodymium-iron-boron-type magnets from electronic waste. Journal of Cleaner Production 104: 236-241.

All references referred to ("cited herein"), and all references cited or referenced in this document are hereby or in any document incorporated by reference herein. Along with any manufacturer's instructions, instructions, product specifications, and product sheets for any of the products listed, they can be incorporated herein by reference and used in the practice of the invention. More specifically, all references are incorporated by reference to the extent that each individual reference is specifically and individually indicated to be incorporated by reference.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A method of atomic hydrogen decrepitation of a ferromagnetic alloy, wherein the method comprises;

electrolyzing an aqueous solution, thereby releasing an atomic hydrogen from a cathode within an electrochemical cell; and reacting the ferromagnetic alloy with the released atomic hydrogen, wherein the ferromagnetic alloy is attached to the cathode;

to obtain a ferromagnetic alloy powder having grain size ≤50 μm.

2. The method of claim 1, wherein the aqueous solution comprises a KOH or NaOH aqueous solution.

3. The method of claim 1, wherein the atomic hydrogen is released from the cathode by a reduction reaction of $2H^{+}(aq)+2e^{-}\rightarrow 2H(g)$.

4. The method of claim 3, wherein the H+ is a result of electrolysis of the water (H2O) within the aqueous solution electrolysis step.

5. The method of claim 1, wherein the cathode is copper, nickel, steel, titanium or any combination thereof.

6. The method of claim 1, wherein, an anode within the electrochemical cell is a lead, nickel, steel or combination thereof.

7. The method of claim 1, wherein the aqueous solution electrolysis is conducted at room temperature.

8. The method of claim 1, wherein the aqueous solution electrolysis is conducted at a potential is between 4-10 V.

9. A method for recovery of at least one rare earth metal from ferromagnetic alloy, the method comprises:

(a) Pre-treating a ferromagnetic alloy by atomic hydrogen decrepitation according to claim 1 to form a powder ferromagnetic alloy;

(b) reacting the ferromagnetic powder alloy with at least one chlorine-containing gas to obtain a volatile iron-containing chloride product and non-volatile at least one rare earth metal chloride;

(c) providing air flow to said volatile iron-containing chloride product, thereby oxidizing the iron-containing chloride product to iron oxide;

(d) separating said iron oxide product and non-volatile at least one rare earth metal chloride;

(e) cooling said separated non-volatile at least one rare earth metal chloride;

(f) electrolyzing said cooled non-volatile at least one rare earth metal chloride;

thereby recovering said at least one rare earth metal.

10. The method of claim 1, wherein said electrolyzing is performed using the cathode of copper, nickel, steel, titanium or combination thereof, and an anode of lead, nickel, steel or combination thereof.

11. At least one rare earth metal composition prepared by the method of claim 9.

12. A method for recovery of at least one rare earth metal from a ferromagnetic alloy, the method comprises:

(a) reacting the ferromagnetic alloy with at least one chlorine-containing gas to obtain a volatile iron-containing chloride product and non-volatile at least one rare earth metal chloride;

(b) providing air flow to said volatile iron-containing chloride product, thereby oxidizing the iron-containing chloride product to iron oxide;

(c) separating said iron oxide product and non-volatile at least one rare earth metal chloride;

(d) cooling said separated non-volatile at least one rare earth metal chloride;

(e) electrolyzing said cooled non-volatile at least one rare earth metal chloride;

thereby recovering said at least one rare earth metal.

13. The method of claim 12, wherein prior to reacting the ferromagnetic alloy with at least one chlorine-containing gas of step (a), an optional step is performed:

pre-treating a ferromagnetic alloy by atomic hydrogen decrepitation method, comprising electrolyzing an aqueous solution, thereby releasing an atomic hydrogen from a cathode within an electrochemical cell; and reacting the ferromagnetic alloy with the released atomic hydrogen, wherein the ferromagnetic alloy is attached to the cathode; to obtain a ferromagnetic alloy powder having grain size ≤50 μm.

14. The method of claim 13, wherein the decrepitation is performed at room temperature.

15. The method of claim 12, wherein the at least one rare earth metal is selected from cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb), and yttrium (Y).

16. The method of claim 12, wherein the reaction of step (b) is performed at a temperature of between 400° C. and 450° C.

17. The method of claim 12, wherein the at least one chlorine-containing gas in reaction of step (a) is present in an amount of 0.5-2.0 kg of the chlorine per 1 kg of the ferromagnetic alloy.

18. The method of claim 12, wherein the air flow to the volatile iron-containing chloride product of step (b) is present in an amount of 0.5-2.0 kg of the air per 1 kg of the volatile iron-containing chloride product.

19. At least one rare earth metal composition prepared by the method of claim 12.

* * * * *